US011162205B2

(12) United States Patent
Kim et al.

(10) Patent No.: US 11,162,205 B2
(45) **Date of Patent: *Nov. 2, 2021**

(54) WASHING MACHINE

(71) Applicant: Samsung Electronics Co., Ltd., Suwon-si (KR)

(72) Inventors: Dong Young Kim, Seoul (KR); Adam Wishney, Singapore (SG); Doo Young Ryu, Suwon-si (KR); In Ju Lee, Yongin-si (KR)

(73) Assignee: Samsung Electronics Co., Ltd., Suwon-si (KR)

( * ) Notice: Subject to any disclaimer, the term of this patent is extended or adjusted under 35 U.S.C. 154(b) by 0 days.

This patent is subject to a terminal disclaimer.

(21) Appl. No.: 16/946,916

(22) Filed: Jul. 10, 2020

(65) Prior Publication Data

US 2020/0340162 A1 Oct. 29, 2020

Related U.S. Application Data

(63) Continuation of application No. 16/206,665, filed on Nov. 30, 2018, now Pat. No. 10,738,406, which is a (Continued)

(30) Foreign Application Priority Data

Feb. 25, 2015 (KR) ..... 10-2015-0026866

(51) Int. Cl.

| | |
|---|---|
| ***D06F 39/14*** | (2006.01) |
| ***D06F 37/28*** | (2006.01) |
| *D06F 37/10* | (2006.01) |

(52) U.S. Cl.

CPC ..... *D06F 37/28* (2013.01); *D06F 39/14* (2013.01); *D06F 37/10* (2013.01)

(58) Field of Classification Search

CPC ..... D06F 37/28; D06F 37/10; D06F 9/14

See application file for complete search history.

(56) References Cited

U.S. PATENT DOCUMENTS

| | | | |
|---|---|---|---|
| 1,549,965 | A | 8/1925 | Everett |
| 2,296,264 | A | 9/1942 | Breckenridge |

(Continued)

FOREIGN PATENT DOCUMENTS

| | | | |
|---|---|---|---|
| CN | 1607290 | A | 4/2005 |
| CN | 1746413 | A | 3/2006 |

(Continued)

OTHER PUBLICATIONS

Office Action in connection with Korean Application No. 10-2015-0026866 dated Apr. 13, 2016, 12 pages.

(Continued)

*Primary Examiner* — Kimberley S Wright

(57) ABSTRACT

A washing machine of the present disclosure includes a cabinet having a first opening and a door assembly provided to open and close the first opening, wherein the door assembly includes a door main body having a second opening provided to be opened and closed independently of the first opening and a rear holder corresponding to the first opening, and the rear holder includes a door sealing unit spaced apart from the second opening and provided to come in contact with the diaphragm to seal the inside of the cabinet when the first opening is closed by a door assembly. By the configuration, the cabinet can be sealed more effectively, and laundry items or detergent may be additionally inserted even during a washing process.

15 Claims, 17 Drawing Sheets

Related U.S. Application Data continuation of application No. 15/255,120, filed on Sep. 1, 2016, now Pat. No. 10,301,760, which is a continuation of application No. PCT/KR2016/001699, filed on Feb. 22, 2012.

(56) References Cited

U.S. PATENT DOCUMENTS

| | | | | |
|---|---|---|---|---|
| 2,813,414 | A | 11/1957 | Johnston | |
| 2,887,864 | A | 5/1959 | Tegerdine | |
| 3,505,836 | A | 4/1970 | Langston | |
| 5,548,978 | A | 8/1996 | Bongini et al. | |
| 6,327,729 | B1 | 12/2001 | Wunderlich et al. | |
| 6,463,768 | B1 | 10/2002 | Shaw et al. | |
| 7,320,186 | B2 | 1/2008 | Schone | |
| 7,559,156 | B2 | 7/2009 | Renzo | |
| 7,614,162 | B2 | 11/2009 | Renzo | |
| 8,099,983 | B2 | 1/2012 | Ballheimer et al. | |
| 8,266,816 | B2 | 9/2012 | Lim | |
| 8,746,017 | B2 | 6/2014 | Huerth et al. | |
| 8,844,328 | B2 | 9/2014 | Loss | |
| 9,115,461 | B2 | 8/2015 | Anderson et al. | |
| 9,169,592 | B2 * | 10/2015 | Kim | D06F 37/26 |
| 9,217,218 | B2 | 12/2015 | Kim et al. | |
| 9,388,523 | B2 | 7/2016 | Han et al. | |
| 9,469,931 | B2 | 10/2016 | Anderson et al. | |
| D771,336 | S | 11/2016 | Kang et al. | |
| D788,388 | S | 5/2017 | Lee | |
| 9,790,637 | B2 * | 10/2017 | Kim | D06F 39/14 |
| 9,856,593 | B2 | 1/2018 | Wishney et al. | |
| 9,903,059 | B2 | 2/2018 | Anderson et al. | |
| 9,926,659 | B2 * | 3/2018 | Kim | D06F 29/00 |
| 9,970,143 | B2 | 5/2018 | Cheon et al. | |
| 10,280,546 | B2 * | 5/2019 | Kim | D06F 37/10 |
| 2004/0020246 | A1 | 2/2004 | Yun et al. | |
| 2004/0163426 | A1 | 8/2004 | Kim et al. | |
| 2004/0244438 | A1 | 12/2004 | North | |
| 2005/0034486 | A1 | 2/2005 | Bienick et al. | |
| 2005/0072194 | A1 | 4/2005 | Ryohke et al. | |
| 2006/0053842 | A1 | 3/2006 | Je | |
| 2006/0265899 | A1 | 11/2006 | Renzo | |
| 2006/0265959 | A1 | 11/2006 | Renzo | |
| 2007/0051012 | A1 | 3/2007 | Schoene | |
| 2007/0125132 | A1 | 6/2007 | Hwang | |
| 2008/0028804 | A1 | 2/2008 | Hoppe et al. | |
| 2009/0260163 | A1 * | 10/2009 | Kim | D06F 37/26 8/159 |
| 2009/0301143 | A1 | 12/2009 | Ballheimer et al. | |
| 2010/0031581 | A1 | 2/2010 | Kang et al. | |
| 2010/0088917 | A1 | 4/2010 | Lim | |
| 2011/0025178 | A1 | 2/2011 | Schone | |
| 2012/0049703 | A1 | 3/2012 | Fang et al. | |
| 2013/0002113 | A1 | 1/2013 | Loss | |
| 2013/0160501 | A1 | 6/2013 | Anderson et al. | |
| 2014/0075684 | A1 | 3/2014 | Kim et al. | |
| 2015/0008807 | A1 | 1/2015 | Kim et al. | |
| 2015/0123520 | A1 * | 5/2015 | Kim | D06F 39/14 312/228 |
| 2015/0211167 | A1 * | 7/2015 | Kim | D06F 29/00 68/140 |
| 2017/0137985 | A1 | 5/2017 | Kim | |
| 2017/0183803 | A1 | 6/2017 | Kim et al. | |
| 2017/0260678 | A1 * | 9/2017 | Wee | D06F 37/266 |
| 2017/0342621 | A1 | 11/2017 | Chun et al. | |
| 2018/0038040 | A1 | 2/2018 | Kim et al. | |

FOREIGN PATENT DOCUMENTS

| | | | | |
|---|---|---|---|---|
| CN | 201762574 U | | 3/2011 | |
| CN | 103572547 A | | 2/2014 | |
| DE | 2244751 A1 | * | 3/1974 | D06F 37/28 |
| DE | 2244751 A1 | | 3/1974 | |
| EP | 1389643 A2 | * | 2/2004 | D06F 37/28 |
| EP | 1389643 A2 | | 2/2004 | |
| EP | 2415920 A1 | | 2/2012 | |
| EP | 2930263 A1 | | 10/2015 | |
| JP | 2012-075689 A | | 4/2012 | |
| KR | 10-2004-0015480 A | | 2/2004 | |
| KR | 10-2007-0002336 A | | 1/2007 | |
| KR | 10-2008-0010702 A | | 1/2008 | |
| KR | 10-2009-0096948 A | | 9/2009 | |
| KR | 20090096948 | * | 9/2009 | |
| KR | 10-2012-0022364 A | | 3/2012 | |
| KR | 10-2013-0123544 A | | 11/2013 | |
| KR | 10-1481518 B1 | | 1/2015 | |
| WO | 2011063486 A1 | | 6/2011 | |

OTHER PUBLICATIONS

Office Action in connection with Korean Application No. 10-2015-0026866 dated Sep. 27, 2016, 13 pages.
International Search Report in connection with International Application No. PCT/KR2016/001699 dated May 24, 2016, 7 pages.
Detailed Ground(s) for Rejection in connection with Korean Application No. 10-2015-0026866 dated Jan. 25, 2017, 4 pages.
Detailed Ground(s) for Rejection in connection with Korean Application No. 10-2015-0026866 dated Mar. 24, 2017, 5 pages.
Office Action in connection with Korean Patent Application No. 10-2017-0046121 dated Jun. 12, 2017, 6 pages.
Office Action in connection with Korean Patent Application No. 10-2017-0046121 dated Sep. 27, 2017.
Office Action in connection with Canadian Patent Application No. 2,943,973 dated Oct. 17, 2017.
Office Action in connection with Korean Patent Application No. 10-2017-0046121 dated Mar. 26, 2018.
Office Action in connection with Australian Patent Application No. 2016224314 dated May 9, 2018.
Extended European Search Report in connection with European Application No. 16755822.0 dated Dec. 20, 2017, 8 pages.
Examination report in connection with Canadian Application No. CA2,943,973 dated May 8, 2018, 3 pages.
Examination report in connection with Korean Application No. KR10-2018-0046611 dated Aug. 1, 2018, 4 pages.
Decision to Grant for Application in connection with Russian Application No. RU2017129902/12 dated Jun. 9, 2018, 15 pages.
Notice of acceptance or patent application in connection with Australian Application No. AU 2016224314 dated Sep. 13, 2018, 3 pages.
The First Office Action in connection with Chinese Application No. CN 201680002519.0 dated Oct. 29, 2018, 17 pages.
Detailed Ground of Rejection in connection with Korean Application No. KR 10-2018-0046611 dated Oct. 28, 2018, 10 pages.
Examination Report in connection with Indian Application No. 201717030136 dated Feb. 17, 2020, 5 pages.
Notice of Patent Decision in connection with Korean Application No. KR 10-2017-0046121 dated Oct. 29, 2019, 3 pages.
Communication pursuant to Article 94(3) EPC in connection with European Application No. EP16755822.0 dated Nov. 21, 2019, 4 pages.
Notice of Allowance in connection with Korean Patent Application No. 10-2018-0046611 dated Jul. 3, 2019, 3 pages.
Notice of Allowance in connection with Canadian Application No. CA 2,943,973 dated Apr. 18, 2019, 1 page.
Communication pursuant to Article 94(3) EPC in connection with European Application No. EP16755822.0 dated Mar. 11, 2019, 5 pages.
European Search Report dated Apr. 26, 2021 in connection with European Application No. 21151118.3, 9 pages.

* cited by examiner

WASHING MACHINE

CROSS-REFERENCE TO RELATED APPLICATIONS

This application is a continuation of application Ser. No. 16/206,665, filed Nov. 30, 2018, which is a continuation of application Ser. No. 15/255,120, filed Sep. 1, 2016, now U.S. Pat. No. 10,301,760, which is a continuation of International Application No. PCT/KR2016/001699, filed Feb. 22, 2016, which claims priority to Korean Patent Application No. 10-2015-0026866 filed Feb. 25, 2015, each of which are hereby incorporated by reference into the present disclosure as if fully set forth herein.

BACKGROUND

1. Field

The present disclosure relates to a washing machine, and more particularly, to a washing machine with an improved insertion structure to facilitate insertion of laundry items.

2. Description of Related Art

Generally, a washing machine is an apparatus which washes clothing articles using electricity, and types of the washing machine include a drum-type washing machine in which a rotary tub is horizontally disposed and laundry items are washed by being lifted upward and lowered along an inner circumferential surface of the rotary tub when the rotary tub rotates back and forth about a horizontal axis, and a vertical-axis washing machine in which a rotary tub having a pulsator therein is vertically disposed and laundry items are washed using a water current generated by the pulsator when the rotary tub rotates back and forth with about a vertical axis.

Generally, the drum-type washing machine includes a cabinet, a tub that retains wash water inside the cabinet, and a drum that accommodates laundry items and is rotatably installed inside the tub. An opening is provided at the cabinet, and the opening is provided to be opened and closed by a door.

With laundry items, detergent, and wash water are inserted in the drum, the drum rotates to agitate the laundry items together with the wash water in order to remove dirt on the laundry items.

In this process, the laundry items are inserted through the opening provided at the cabinet, and the detergent and the wash water are provided to be fed by a detergent feed device.

However, once a washing operation of the drum-type washing machine begins, the door of the drum-type washing machine remains locked. Thus, in order to open the door during a washing process, it is required to either wait until the washing operation is finished or stop the washing operation and wait until draining of wash water is finished. Thus, there is a problem of a limitation on additionally inserting laundry items or detergent into the drum during the washing process.

SUMMARY

To address the above-discussed deficiencies, it is a primary object to provide a washing machine with an improved structure for inserting laundry items or detergent to enable freely inserting the laundry items or the detergent.

It is another aspect of the present disclosure to provide a washing machine with an improved insertion structure to enable freely inserting laundry items or detergent during a washing operation.

It is still another aspect of the present disclosure to provide a washing machine with an improved structure to provide an additional washing space.

It is yet another aspect of the present disclosure to provide a washing machine into which laundry items or detergent can be additionally supplied.

A washing machine according to various embodiments of the present disclosure includes a cabinet having a first opening, a tub configured to retain wash water inside the cabinet, a drum rotatably provided inside the tub, a diaphragm that connects the cabinet to the tub, and a door assembly provided to open and close the first opening, wherein the door assembly may include a door main body having a second opening provided to be opened and closed independently of the first opening and a rear holder corresponding to the first opening and provided to be rotatable with respect to the cabinet, and the rear holder may include a door sealing unit spaced apart from the second opening and coming in contact with the diaphragm when the first opening is closed by the door assembly in order to seal an inside of the cabinet.

The second opening may be disposed to be spaced apart toward the inside of the door sealing unit to prevent a holder opening from interfering with the diaphragm when the first opening is closed by the door assembly.

The door sealing unit may be provided to come in contact with the whole region of the circumference of the diaphragm.

The door sealing unit may be disposed in a ring shape to correspond to the diaphragm.

The door sealing unit may include a first sealing unit provided to face the diaphragm and a second sealing unit formed to extend from the first sealing unit and formed to be bent toward the rear at an inside of the first sealing unit.

The diaphragm may be provided to come in contact with at least one of the first sealing unit and the second sealing unit.

The door assembly may include a door glass provided to allow the inside of the drum to be viewed, and the door glass and a rear end of the second opening may be disposed at an inside of the door sealing unit in the rear holder.

The door sealing unit may be integrally formed with the rear holder.

The rear holder and the door sealing unit may be formed of a glass material.

The door sealing unit may be formed of at least one of a glass and an elastic member.

The door assembly may further include a sub-door provided in the door main body to be able to open and close the second opening.

The door main body may include a front cover having the sub-door rotatably provided and coupled to the front of the rear holder and a connection chute that forms the second opening between the front cover and the rear holder.

A washing machine according to an aspect of the present disclosure includes a cabinet having a first opening, a tub that retains wash water inside the cabinet, a drum rotatably provided inside the tub, and a door assembly provided to open and close the first opening, wherein the door assembly may include a door main body having a door glass corresponding to the first opening and provided to be rotatable with respect to the cabinet and a second opening provided in the door main body to be opened and closed independently of the first opening, and the door glass may include a glass opening configured to be open corresponding to the second opening.

The washing machine may include a diaphragm formed to extend from the tub to the first opening of the cabinet, and the door glass may be provided to come in contact with the diaphragm to seal the inside of the cabinet when the first opening is closed by the door assembly.

The door glass may include a door sealing unit that comes in contact with the diaphragm, and the glass opening may be formed inside of the door sealing unit not to interfere with the diaphragm when the first opening is closed by the door assembly.

The door glass may further include a door sealing unit provided to correspond to the first opening to come in contact with the diaphragm and a glass body convexly formed further rearward than the door sealing unit inside of the door sealing unit to be accommodated in a hollow portion of the diaphragm when the first opening is closed.

The door sealing unit and the glass body may be integrally formed.

The door sealing unit may be disposed in a ring shape to correspond to the diaphragm.

The glass opening may be disposed at an upper portion of the glass body.

The door assembly may further include a sub-door provided in the door main body to be able to open and close the second opening.

The door main body may include a front cover having the sub-door rotatably provided and coupled to the front of a rear holder and a connection chute that forms the second opening between the front cover and the rear holder.

A user may open and close a sub-door at a random point during a washing operation to freely insert laundry items or detergent.

Further, separate washing according to types of laundry items is possible by installing a sub-washing space separate from a main washing space, and accordingly, an extent of damage to the laundry items can be lowered.

Further, methods of inserting laundry items or feeding detergent can be diversified.

Further, laundry items or detergent can be additionally inserted even during an operation of the washing machine.

Further, a material of a door can be diversified, thereby reducing the manufacturing cost and making manufacturing the door in various shapes possible.

Further, a door sealing structure can be improved to more effectively seal the inside of a cabinet.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1:
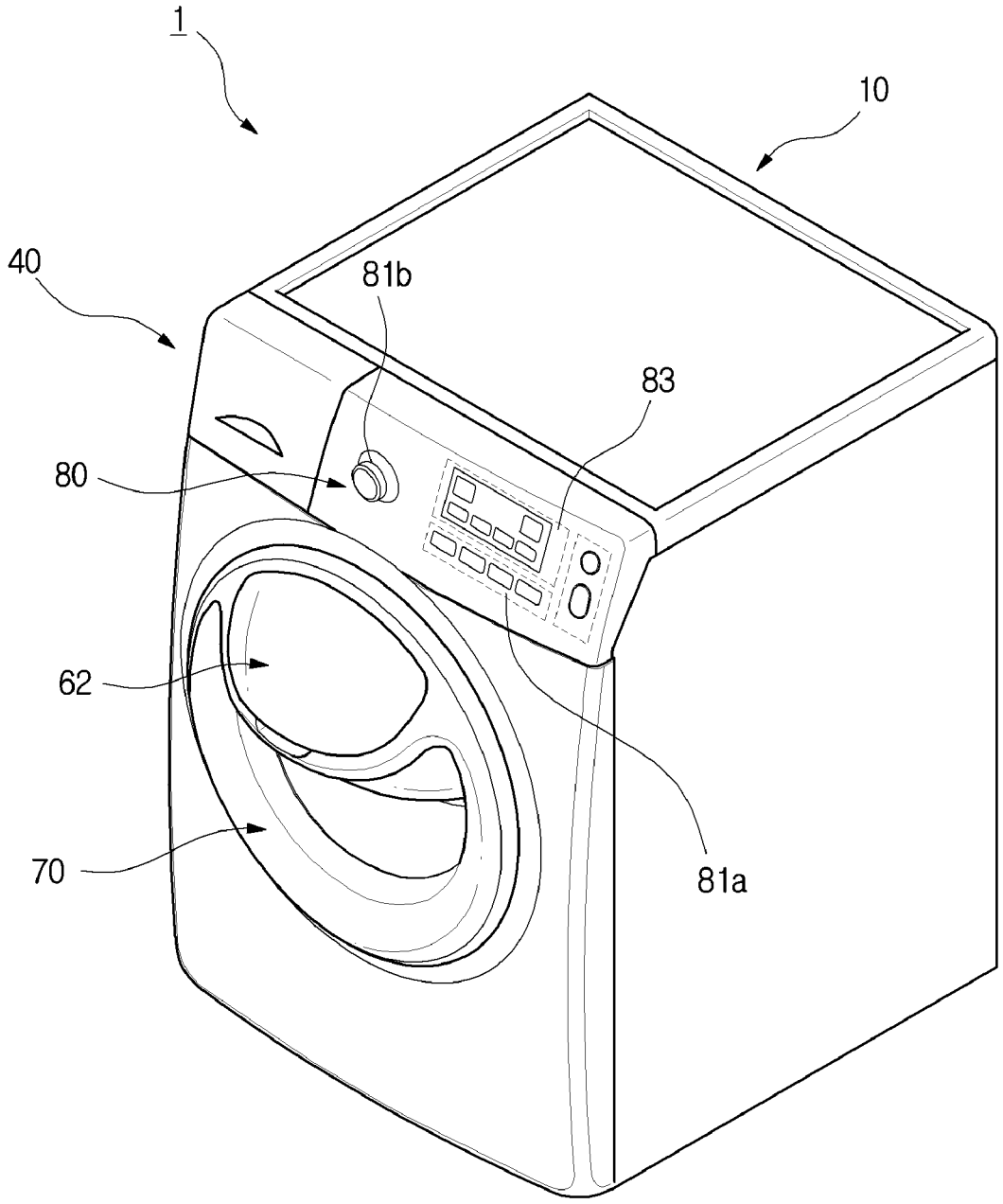
FIG. 1 illustrates an exterior of a washing machine according to various embodiments of the present disclosure.

FIGS. 1 through 17, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any chuteably arranged device.

Embodiments described herein and configurations illustrated in the drawings are merely preferred examples of the present disclosure, and various modified examples that may substitute for the embodiments and the drawings of the present specification may exist at the time of filing the present application.

In addition, like reference numerals or marks shown throughout the drawings of the present specification represent parts or elements that perform substantially the same functions.

In addition, terms used in the present specification are used for describing the embodiments and are not intended to limit and/or restrict the invention disclosed herein. Singular expressions include plural expressions unless clearly meaning otherwise in the context. In the present specification, terms such as "include" or "have" are to designate that features, numbers, steps, operations, elements, parts described in this specification or combinations thereof are present, and are not for excluding a presence or a possibility of adding one or more other features, numbers, steps, operations, elements, parts or combinations thereof in advance.

In addition, although terms including ordinals such as "first" and "second" used in this specification may be used to describe various elements, the elements are not limited by the terms, and the terms are used only for the purpose of distinguishing one element from another element. For example, a first element may be referred to as a second element, and similarly, a second element may be referred to as a first element while not departing from the scope of the present disclosure. The term "and/or" includes a combination of a plurality of related described items or any one item among the plurality of related described items.

Hereinafter, preferred embodiments according to the present disclosure will be described in detail with reference to the accompanying drawings. Meanwhile, terms such as "front end", "rear end", "upper portion", "lower portion", "upper end" and "lower end" used in the description below are defined based on the drawings, and shapes and positions of each of the elements are not limited by the terms.

Hereinafter, embodiments according to the present disclosure will be described in detail with reference to the accompanying drawings.

Figure 2:
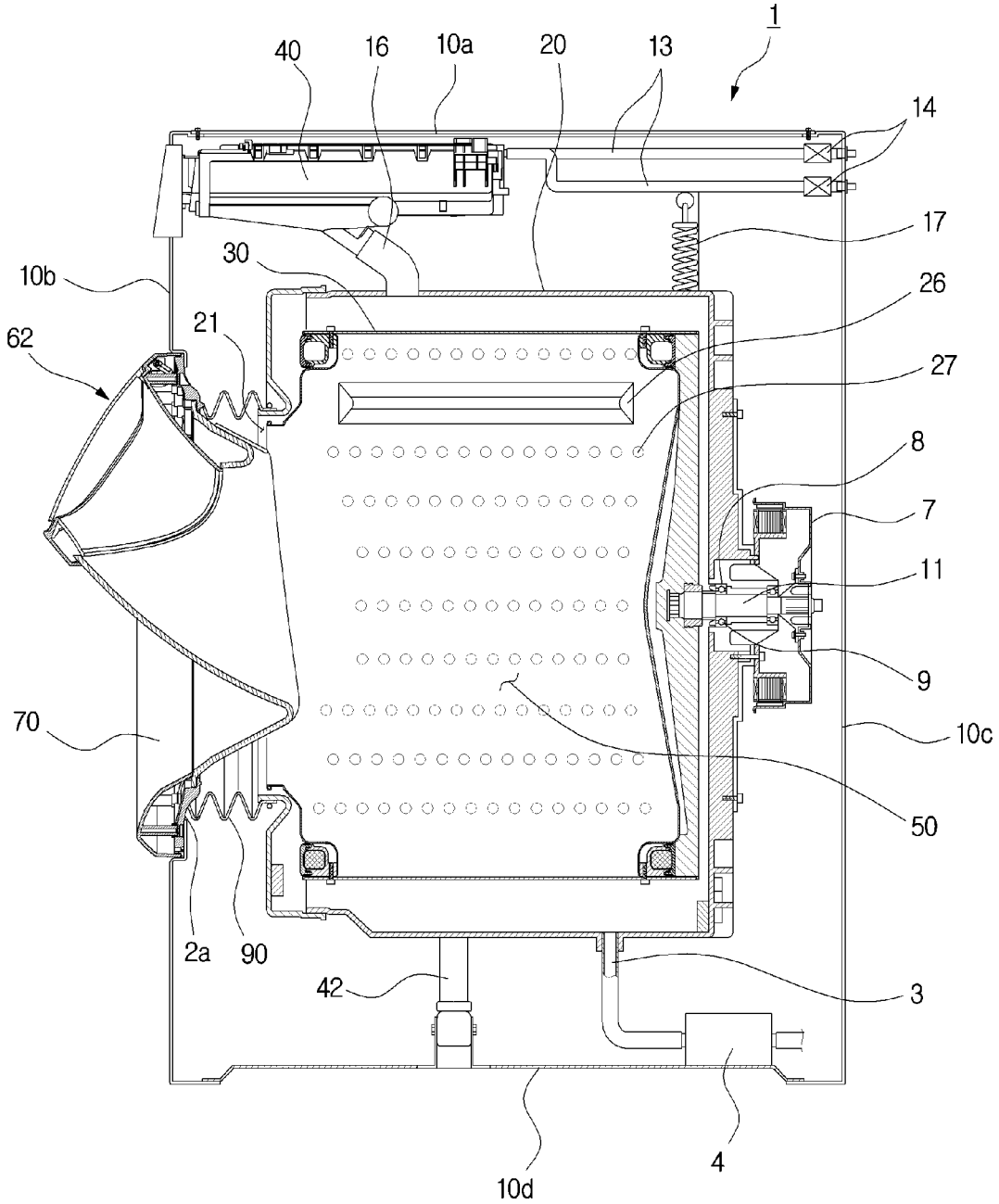
FIG. 2 illustrates a configuration of the washing machine according to various embodiment of the present disclosure.
Figure 3:
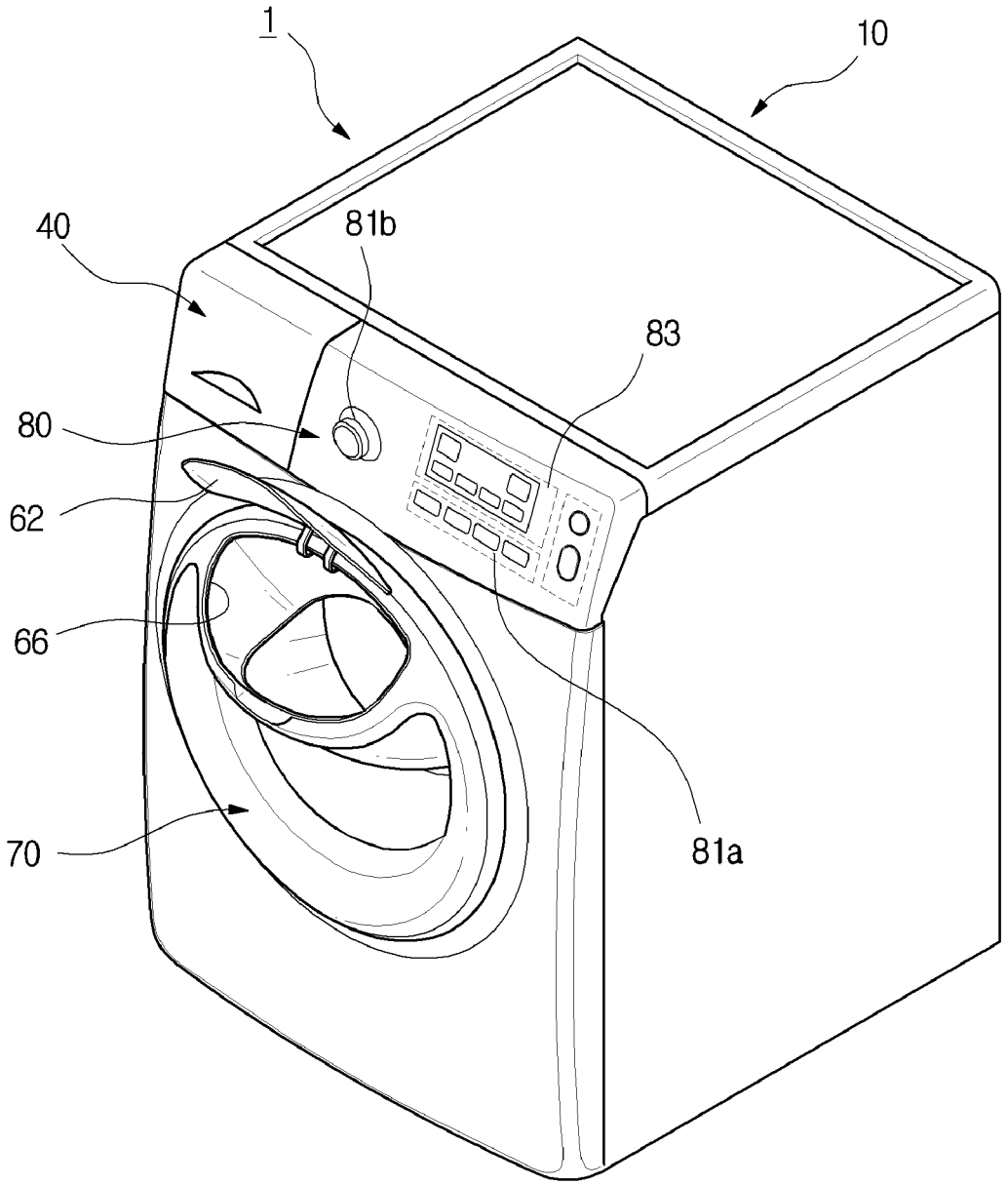
FIG. 3 illustrates a state in which a sub-door of the washing machine is open according to the various embodiments of the present disclosure.
Figure 4:
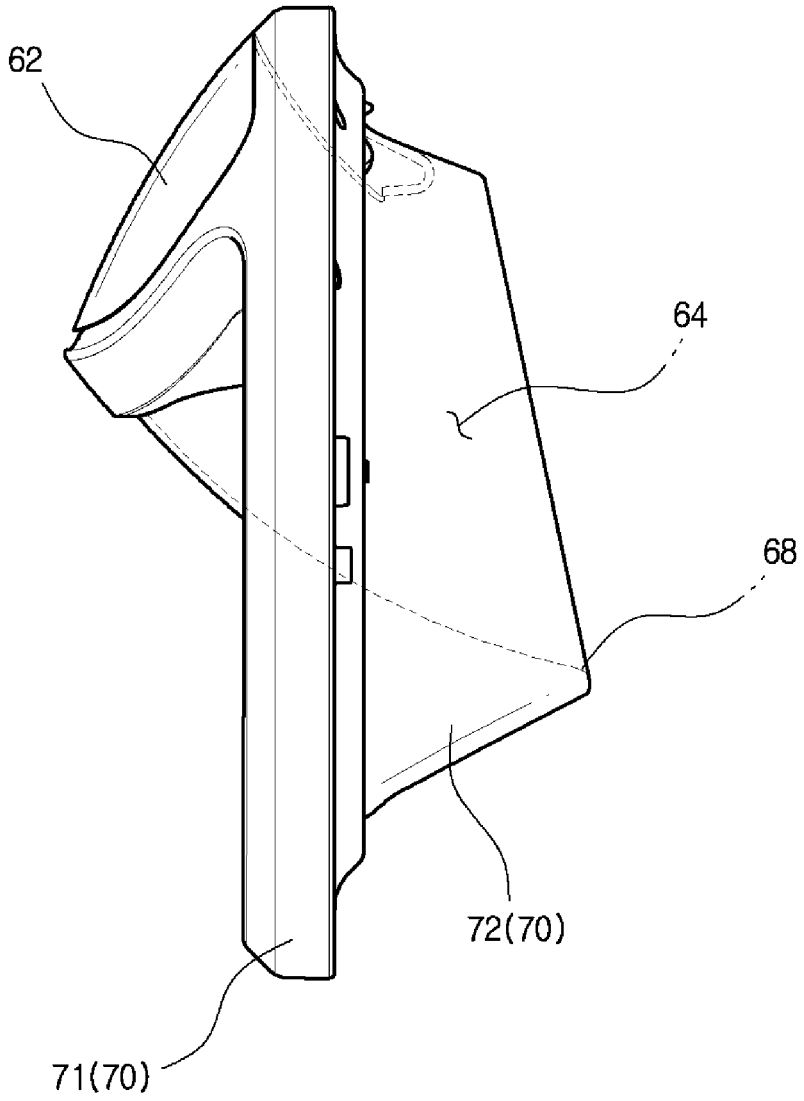
FIG. 4 illustrates a door of the washing machine according to the various embodiments of the present disclosure.

FIG. 1 is a perspective view illustrating an exterior of a washing machine according to an embodiment of the present disclosure, and FIG. 2 is a cross-sectional view illustrating a configuration of the washing machine according to the embodiment of the present disclosure. FIG. 3 is a perspective view illustrating a state in which a sub-door of the washing machine according to the embodiment of the present disclosure is open, and FIG. 4 is a lateral view illustrating a door of the washing machine according to the embodiment of the present disclosure.

As illustrated in FIGS. 1 to 4, a washing machine 1 includes a cabinet 10 that forms an exterior thereof, a tub 20 that accommodates wash water or rinse water to be used in a washing operation or a rinsing operation, a drum 30 that accommodates laundry items, and a driving motor 7 that rotates the drum 30.

At the cabinet 10, a control panel 80 including input units 81*a* and 81*b* that receive an operation command of the washing machine 1 from a user and a display unit 83 that displays operation information of the washing machine 1 are provided.

The input units 81*a* and 81*b* may receive a user command related to an operation of the washing machine 1 including washing time, number of rinses, spin-drying time, drying time, start and pause, etc. and may employ a pressure sensitive button 81*a* or a rotary button 81*b*. In addition, the display unit 83 may display information related to an operation of the washing machine 1 including an amount of wash water, an operation being performed by the washing machine 1, and an amount of remaining time until washing is finished, etc. and may employ a liquid crystal display (LCD) panel, a light-emitting diode (LED) panel, etc.

Although the input units 81*a* and 81*b* and the display unit 83 are separately provided in the washing machine 1 according to the embodiment of the present invention, embodiments are not limited thereto and a touch screen panel (TSP) may be employed to integrally provide an input unit and a display unit.

In addition, the cabinet 10 includes frames 10*a*, 10*b*, 10*c*, and 10*d*, and the frames 10*a*, 10*b*, 10*c*, and 10*d* include an upper frame 10*a* that forms an upper surface of the cabinet, a front frame 10*b* and a rear frame 10*c* that form front and rear surfaces of the cabinet 10, and lateral frames (not shown) and a lower frame 10*d* that connect the front frame 10*b* to the rear frame 10*c* and form lateral surfaces and a lower surface of the cabinet 10.

A first laundry item inlet 2*a* is formed at the front frame 10*b* of the cabinet 10 for inserting laundry items into the drum 30. The first laundry item inlet 2*a* is opened and closed by a door 70 installed at the front frame 10*b* of the cabinet 10.

A diaphragm 90 may connect the cabinet 10 to the tub 20. The diaphragm 90 is disposed between the first laundry item inlet 2*a* of the front frame 10*b* and an opening 21 of the tub 20 to form a passage from the first laundry item inlet 2*a* of the front frame 10*b* to the opening 21 of the drum 30 and reduces vibration transmitted toward the front frame 10*b* while the drum 30 rotates. In addition, a portion of the diaphragm 90 is disposed between the door 70 and the front frame 10*b* to prevent wash water in the tub 20 from leaking to the outside of the cabinet 10.

The diaphragm 90 may be formed of an injection-molded product formed with a thermoplastic elastomer. Since the thermoplastic elastomer has rubber-like elasticity at room temperature, the diaphragm formed of the thermoplastic elastomer can efficiently damp vibration transmitted from the tub 20 to the front frame 10*a* 10*b* of the cabinet 10.

A spring 17 for supporting the tub 20 from an upper side may be provided between the tub 20 and the cabinet 10. The spring 17 performs a role of mitigating vibration and noise generated due to a movement of the tub 20 by an elastic force.

A water supply pipe 13 for supplying wash water to the tub 20 is installed at an upper portion of the tub 20. A water supply valve 14 is installed at one side of the water supply pipe 13.

A detergent feed device 40 is connected to the tub 20 via a connection pipe 16. Water supplied through the water supply pipe 13 passes through the detergent feed device 40 and is fed into the tub 20 together with detergent.

The tub 20 is supported by a damper 42. The damper 42 connects an inside bottom surface of the cabinet 10 to an outside surface of the tub 20. In addition, besides the inside bottom surface of the cabinet 10, the damper 42 may also be disposed at an upper side and left and right sides of the cabinet 10 to support the tub 20. The damper 42 or the spring 17 may mitigate vibration and impact generated from a vertical movement of the tub 20 at upper and lower portions of the tub 20.

The tub 20 may be supported by at least one damper 42.

A driving shaft 11 for transmitting power of the driving motor 7 is connected to a rear surface of the drum 30. A plurality of through-holes 27 for supplying wash water are formed along the circumference of the drum 30. A plurality of lifters 26 are installed at an inner circumferential surface of the drum 30 to allow laundry items to be lifted and lowered while the drum 30 rotates.

The driving shaft 11 is disposed between the drum 30 and the driving motor 7. One end of the driving shaft 11 is connected to a rear plate of the drum 30, and the other end of the driving shaft 11 extends to outside of a rear wall of the tub 20. When the driving motor 7 drives the driving shaft 11, the drum 30 connected to the driving shaft 11 rotates about the driving shaft 11.

A bearing housing 8 is installed at the rear wall of the tub 20 to rotatably support the driving shaft 11. The bearing housing 8 may be provided with an aluminum alloy and may be inserted into the rear wall of the tub 20 during injection-molding of the tub 20. Bearings 9 are installed between the bearing housing 8 and the driving shaft 11 to allow the driving shaft 11 to smoothly rotate.

At a lower portion of the tub 20, a drainage pump 4 for discharging water inside the tub 20 to an outer portion of the cabinet 10, a connection hose 3 that connects the tub 20 to the drainage pump 4 to allow the water inside the tub 20 to be introduced into the drainage pump 4, and a drainage hose (not shown) that guides water pumped by the drainage pump 4 to the outer portion of the cabinet 10 are provided.

The washing machine 1 may further include a sub-door 62 that may be freely opened and closed during a washing process separate from the door 70.

The sub-door 62 may be provided at the door 70 to protrude forward.

The sub-door 62 may be provided at the door 70 to be adjacent to the upper frame 10*a*. Specifically, the sub-door 62 may be installed at a position higher than the water level of wash water to prevent the wash water present in a main washing space 50 or a sub-washing space 60 from overflowing when the sub-door 62 is opened and closed during a washing operation.

The sub-door 62 may be rotatably installed at the door 70.

One side of the sub-door 62 may be coupled to the door 70 by a hinge.

When a left side or a right side of the sub-door 62 is coupled to the door 70 by a hinge, the sub-door 62 may horizontally be opened and closed. When an upper side or a lower side of the sub-door 62 is coupled to the door 70 by a hinge, the sub-door 62 may vertically be opened and closed. Preferably, the upper side of the sub-door 62 may be coupled to the door 70 by a hinge to allow the sub-door 62 to be opened and closed upward.

A locking unit (not shown) may be formed at the other side of the sub-door 62.

The locking unit of the sub-door 62 may be removably inserted into a fixing hole (not shown) formed at the door 70. That is, the sub-door 62 remains closed when the locking unit of the sub-door 62 is inserted into the fixing hole of the door 70, and the sub-door 62 remains open when the locking unit of the sub-door 62 is removed from the fixing hole of the door 70.

The one side of the sub-door 62 coupled to the door 70 by a hinge may face the other side of the sub-door 62 at which the locking unit is formed. That is, when the left side of the sub-door 62 is coupled to the door 70 by a hinge, the locking unit may be formed at the right side of the sub-door 62. When the right side of the sub-door 62 is coupled to the door 70 by a hinge, the locking unit may be formed at the left side of the sub-door 62. When the upper side of the sub-door 62 is coupled to the door 70 by a hinge, the locking unit may be formed at the lower side of the sub-door 62. When the lower side of the sub-door 62 is coupled to the door 70 by a hinge, the locking unit may be formed at the upper side of the sub-door 62.

The sub-door 62 remains locked during a washing process, and when the sub-door 62 is unlocked, the drum 30 stops rotating.

Whether the sub-door 62 is locked, i.e. whether the sub-door 62 is open or closed may be determined by a sensor (not shown). According to an embodiment, whether the sub-door 62 is open or closed may be determined by an optical sensor (not shown). The optical sensor may include a light-emitting unit (not shown) in which a direction of radiating light varies according to a movement of the sub-door 62 and a light-receiving unit (not shown) that receives light radiated from the light-emitting unit to output a signal having a magnitude corresponding to the received amount of light. A control unit (not shown) analyzes the signal output by the light-receiving unit to determine whether the sub-door 62 is open or closed and controls an operation of the drum 30 according to the determined result.

A method of determining whether the sub-door 62 is open or closed is not limited to the above example and may be modified in various ways.

A second laundry item inlet 66 and a connection chute 64 may be provided inside the door 70.

The second laundry item inlet 66 may be opened and closed by the sub-door 62. The connection chute 64 may connect the second laundry item inlet 66 to the drum 30.

The door 70 may include a front housing 71 and a rear housing 72.

The sub-door 62 may be provided in the front housing 71.

The rear housing 72 may be coupled to the front housing 71 so that the connection chute 64 is provided in the rear housing 72, and an opening 68 that communicates with the drum 30 may be formed at the back of the rear housing 72.

The opening 68 may be formed at one end portion of the connection chute 64 facing the rear, and the second laundry item inlet 66 may be formed at the other end portion of the connection chute 64 facing the front.

The connection chute 64 may be tilted downward along a direction of an inside of the door 70. That is, the connection chute 64 may be gradually tilted downward toward the opening 68. Consequently, the second laundry item inlet 66 may be formed at a higher position than the opening 68 upward. This is to allow laundry items or detergent inserted through the second laundry item inlet 66 to slide in the direction of gravity along the connection chute 64 and effectively reach the drum 30.

The rear housing 72 may protrude toward the rear of the door 70.

The extent of the rear housing 72 protruding toward the rear of the door 70 may progressively decrease upward. This is to prevent laundry items inserted through the second laundry item inlet 66 from being damaged due to being stuck in the diaphragm 90 that connects the cabinet 10 to the tub 20.

A diaphragm (not shown) may be installed at least one of the sub-door 62 and the second laundry item inlet 66 to prevent leakage of water.

The diaphragm may be formed of an injection-molded product formed of a thermoplastic elastomer. Since the thermoplastic elastomer has rubber-like elasticity at room temperature, the diaphragm formed of the thermoplastic elastomer can effectively prevent leakage of water.

At least one of the door 70 and the sub-door 62 may be formed of a transparent material to allow a user to check a washing process with a naked eye. According to an embodiment, materials of the door 70 and the sub-door 62 may include tempered glass.

Figure 5:
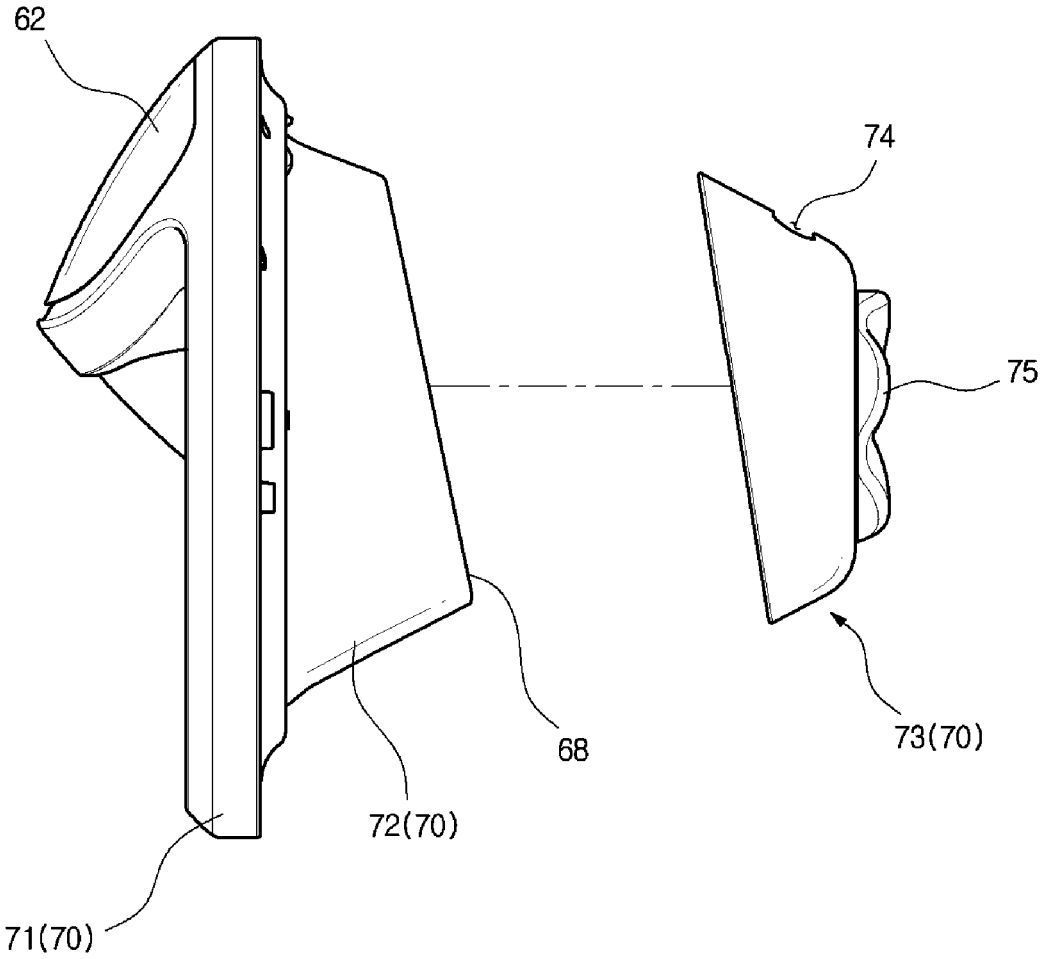
FIG. 5 illustrates a state in which the door of the washing machine and a cover mounted at the rear of the door are coupled according to the various embodiments of the present disclosure.
Figure 6:
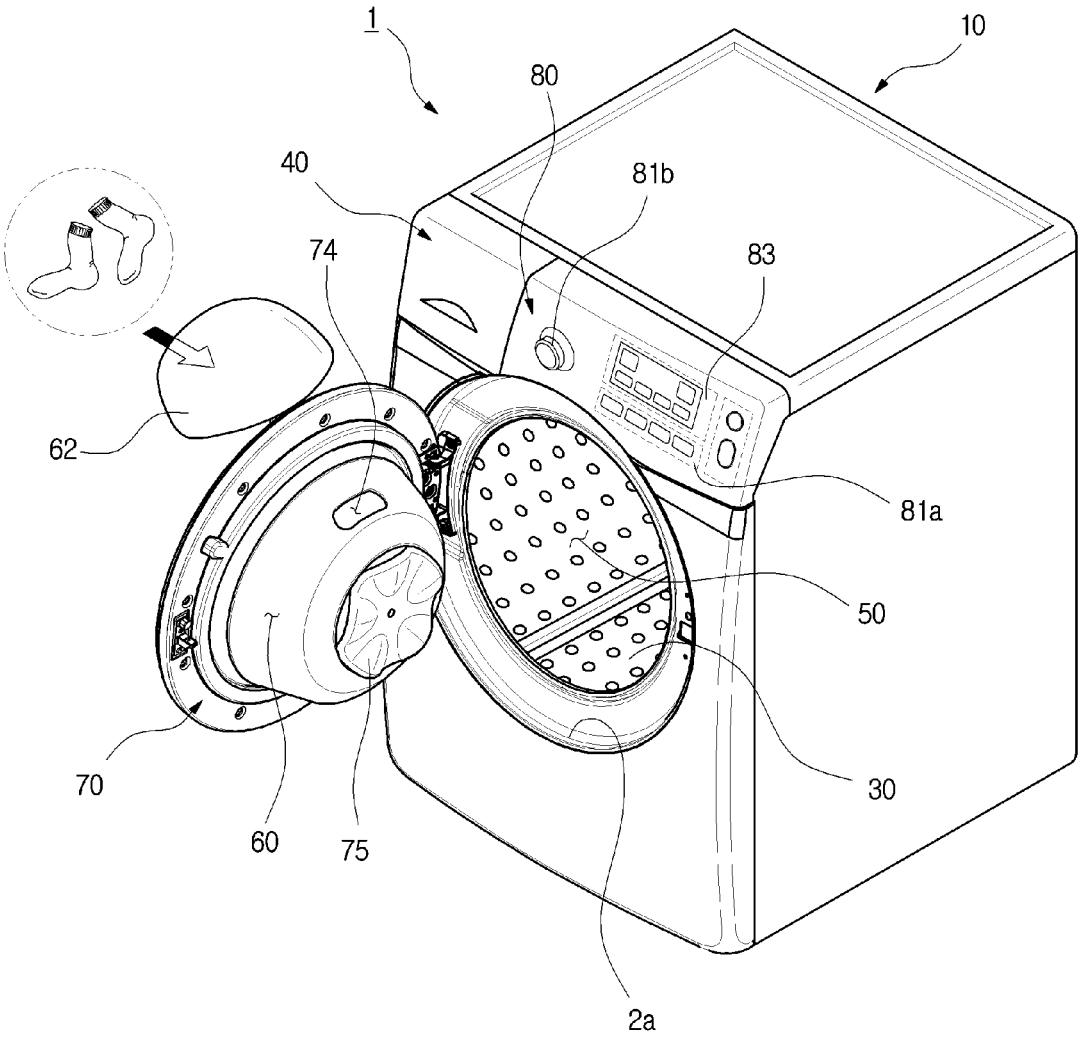
FIG. 6 illustrates a state in which laundry items have been inserted into a sub-washing space of the washing machine according to the various embodiments of the present disclosure.

FIG. 5 is a view illustrating a state in which the door of the washing machine according to the embodiment of the present disclosure and a cover mounted to the rear of the door are coupled, and FIG. 6 is a view illustrating a state in which laundry items have been inserted into the sub-washing space. Hereinafter, unmarked reference numerals should be referred to FIGS. 1 to 4. In addition, descriptions overlapping with those of FIGS. 1 to 4 will be omitted. The connection chute 64 of FIGS. 1 to 4 may be included in the sub-washing space 60.

As illustrated in FIGS. 5 and 6, the washing machine 1 may include the main washing space 50 and the sub-washing space 60.

Washing in the main washing space 50 and washing in the sub-washing space 60 may be performed independently of each other. That is, the sub-washing space 60 may be separate from the main washing space 50.

The main washing space 50 may be formed inside the drum 30.

The sub-washing space 60 may be formed inside the door 70.

The door 70 may include the front housing 71 and the rear housing 72.

The sub-door 62 that opens and closes the sub-washing space 60 may be provided in the front housing 71.

The rear housing 72 may be coupled to the front housing 71 so that the sub-washing space 60 is provided in the rear housing 72, and the opening 68 that communicates with the drum 30 may be formed at the back of the rear housing 72.

The door 70 may further include a cover 73.

Specifically, the cover 73 may be detachably coupled to the opening 68.

The front housing 71, the rear housing 72, and the cover 73 may be coupled to each other to form the sub-washing space 60 separate from the main washing space 50.

The cover 73 may have a transparent material.

A pulsator 75 may be installed at the cover 73 to form a flow in the wash water retained in the sub-washing space 60. The pulsator 75 may rotate due to a flow of wash water generated in the main washing space 50. Consequently, the pulsator 75 may rotate in the same direction with the drum 30.

A diaphragm (not shown) may be installed at least one of the opening 68 and the cover 73 to prevent leakage of water.

A wash water introduction hole 74 may be provided at the cover 73.

Wash water may be sprayed to the sub-washing space 60 separate from the main washing space 50. Specifically, the wash water may be sprayed to the sub-washing space 60 through the wash water introduction hole 74.

The wash water retained in the sub-washing space 60 may be drained separately from the wash water retained in the main washing space 50.

Figure 7:
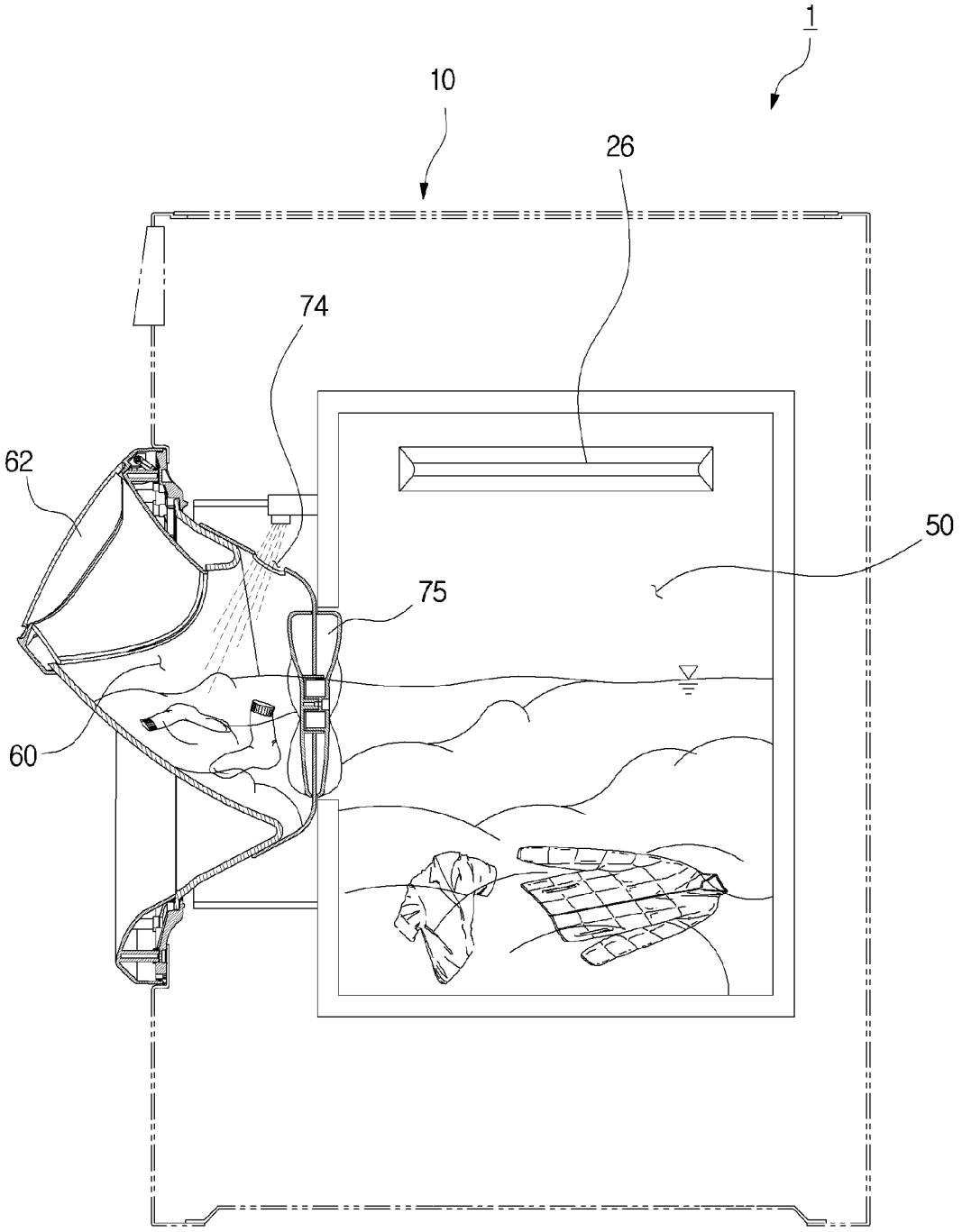
FIG. 7 illustrates a process of a washing operation of the washing machine according to the various embodiments of the present disclosure.

FIG. 7 is a view schematically illustrating a process of a washing operation of the washing machine according to the embodiment of the present disclosure. Unmarked reference numerals should be referred to FIGS. 1 to 6.

As illustrated in FIG. 7, an operational process of the washing machine 1 is as follows.

Once laundry items or detergent is inserted into the main washing space 50 and the sub-washing space 60, a chuteable amount of wash water is supplied to the main washing space 50 and the sub-washing space 60. As described above, wash water may be supplied to the sub-washing space 60 through the wash water introduction hole 74 separate from the main washing space 50.

In a case of the main washing space 50, the drum 30 rotates due to an operation of the driving motor 7, and a lifter 26 lifts laundry items up to a predetermined height and drops the laundry items in order to wash the laundry items.

In a case of the sub-washing space 60, laundry items are washed using a water current generated by the pulsator 75. Since washing in the sub-washing space 60 may be performed more gently than washing in the main washing space 50, laundry items prone to damage may be effectively washed.

When the above washing operation is finished, the wash water in the main washing space 50 and the sub-washing space 60 are drained, and spin-drying is intermittently performed. Then, the water supply valve 14 is opened to supply wash water to the main washing space 50 and the sub-washing space 60 and a rinsing operation is performed at the same time.

In this manner, after the rinsing operation and the intermittent spin-drying are repeatedly performed, a spin-drying operation is performed.

Hereinafter, a washing machine according to another embodiment of the present disclosure will be described.

Figure 8:
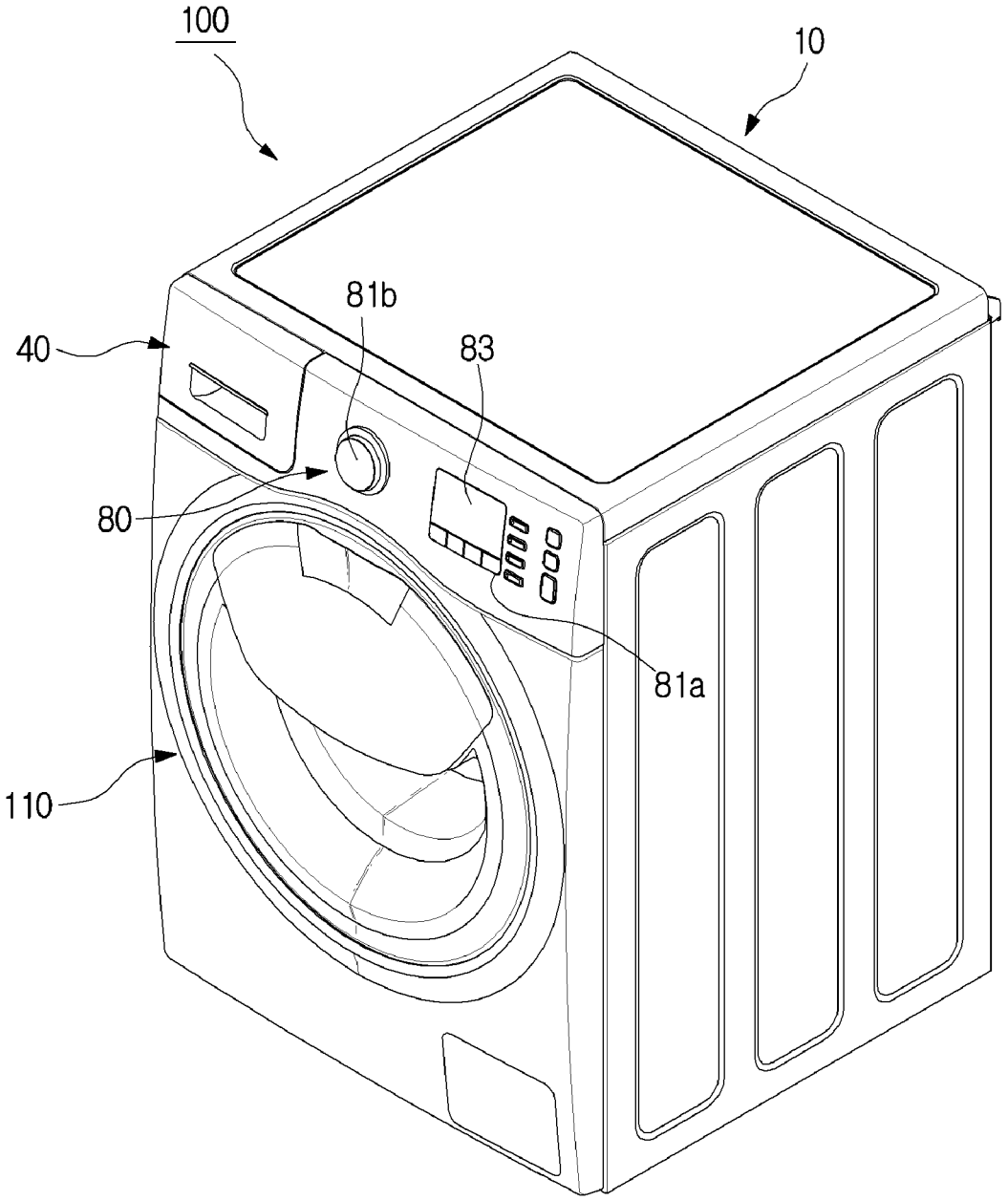
FIG. 8 illustrates a washing machine according to various embodiments of the present disclosure.
Figure 9:
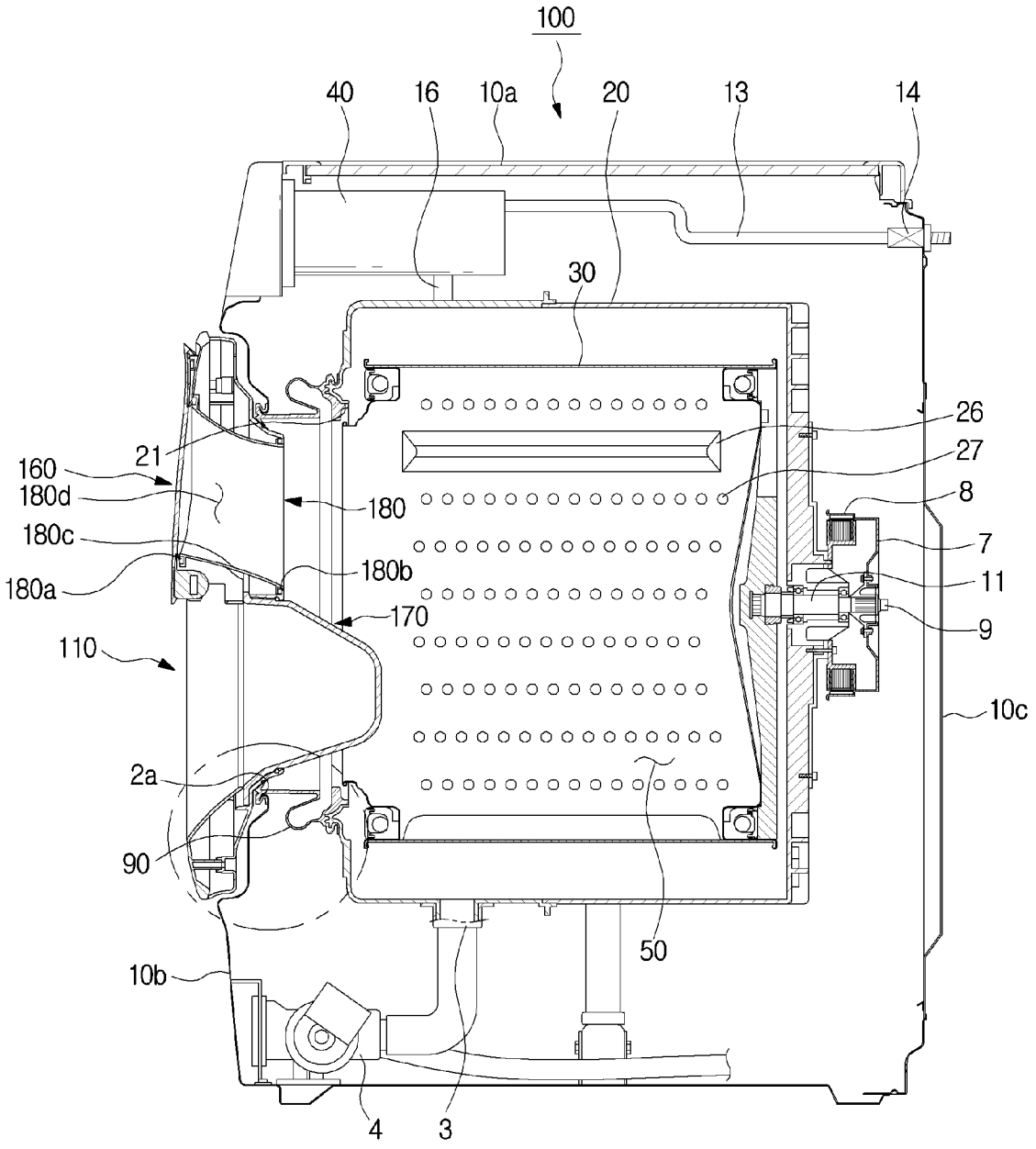
FIG. 9 illustrates the washing machine according to various embodiments of the present disclosure.
Figure 10:
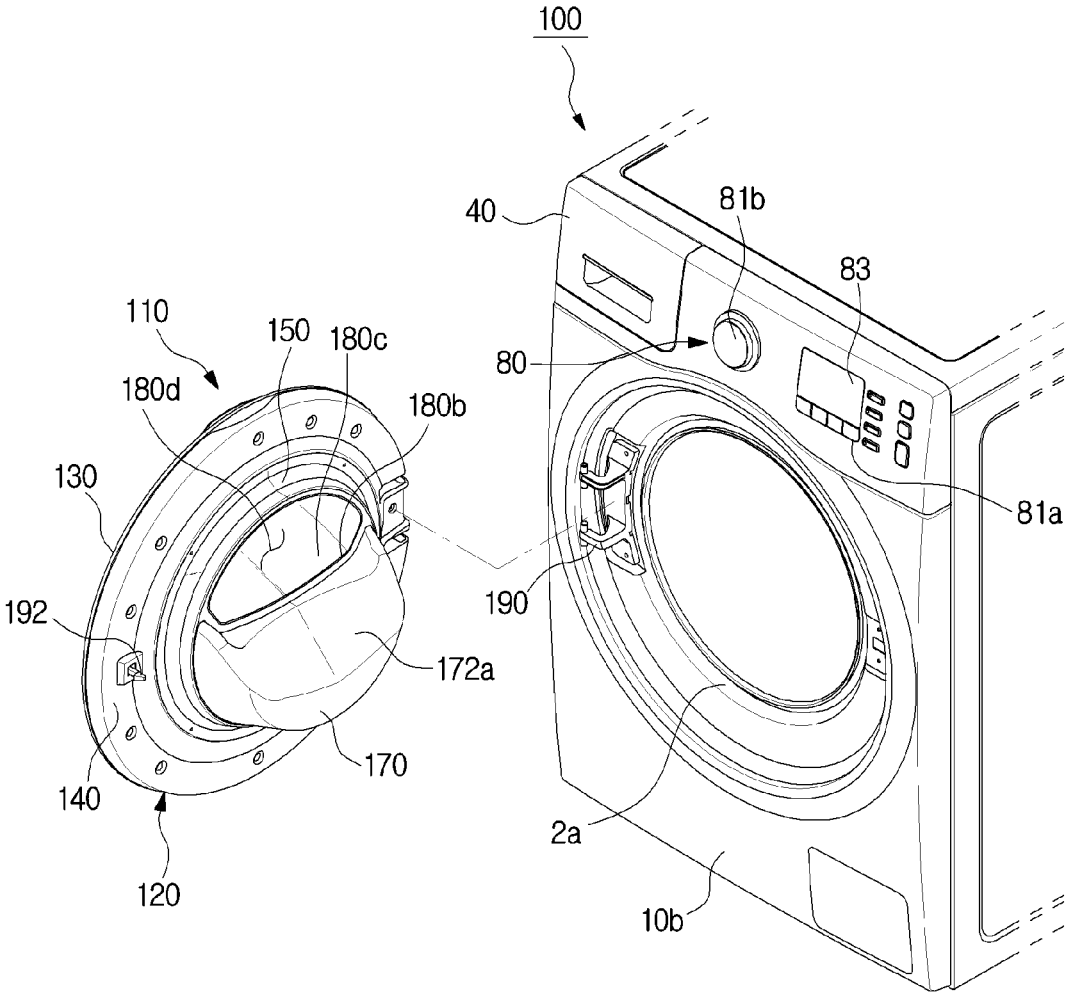
FIG. 10 illustrates a cabinet and a door assembly of the washing machine are detached from each other according to various embodiments of the present disclosure.

FIG. 8 is a perspective view of a washing machine according to another embodiment of the present disclosure, FIG. 9 is a cross-sectional view of the washing machine according to another embodiment of the present disclosure, and FIG. 10 is a view in which a cabinet and a door assembly of the washing machine according to another embodiment of the present disclosure are detached from each other.

A washing machine 100 may include the cabinet 10, the tub 20 that accommodates wash water or rinse water to be used in a washing operation or a rinsing operation, and the drum 30 that accommodates laundry items.

The first laundry item inlet 2*a* is formed at the front frame 10*b* of the cabinet 10 to allow laundry items to be inserted into the drum 30. The first laundry item inlet 2*a* may be opened and closed by a door assembly 110 installed at the front frame 10*b* of the cabinet 10. The first laundry item inlet 2*a* is the same configuration as the laundry item inlet 2*a* in FIG. 2.

The diaphragm 90 may connect the cabinet 10 to the tub 20. Specifically, the diaphragm 90 may be disposed between the first laundry item inlet 2*a* of the cabinet 10 and the opening 21 of the tub 20 corresponding to the first laundry item inlet 2*a*. The diaphragm 90 may form a passage from the first laundry item inlet 2*a* of the cabinet 10 to the opening 21 of the tub 20 and reduce vibration transmitted toward the front frame 10*b* while the drum 30 rotates. In addition, a portion of the diaphragm 90 is disposed between the door assembly 110 and the front frame 10*b* to prevent wash water in the tub 20 from leaking to the outside of the cabinet 10.

The diaphragm 90 may be formed of an injection-molded product formed of a thermoplastic elastomer. Since the thermoplastic elastomer has rubber-like elasticity at room temperature, the diaphragm 90 formed of the thermoplastic elastomer can effectively damp vibration transmitted from the tub 20 to the front frame of the cabinet 10.

The door assembly 110 may include a door main body 120 provided to be rotatable with respect to the cabinet 10.

The door main body 120 may include a front cover 130 and a rear holder 140.

The front cover 130 forms a front surface of the door main body 120, and the rear holder 140 forms at least a portion of a rear surface of the door main body 120 at the rear of the front cover 130. The rear holder 140 is provided to correspond to the first laundry item inlet 2*a*, and the rear holder 140 is provided to come in contact with the first laundry item inlet 2*a* when the door assembly 110 closes the first laundry item inlet 2*a*.

The door assembly 110 may include a door glass 170.

The door glass 170 may be formed of a transparent material to allow the inside of the drum 30 to be viewed from an outside of the washing machine 100 even when the door assembly 110 is at a closed position. The door glass 170 may be disposed to convexly protrude from the rear holder 140. By the configuration, the door glass 170 is provided to be inserted more inward into the cabinet 10 than the first laundry item inlet 2*a* when the door assembly 110 is at the closed position.

The rear holder 140 may include a door sealing unit 150.

The door sealing unit 150 is provided to come in contact with the diaphragm 90 to seal the inside of the cabinet 10 when the door assembly 110 is at the closed position. The door sealing unit 150 will be described in detail below.

A second opening 180*a* provided to be opened and closed independently of the first laundry item inlet 2*a* is provided at the door main body 120. The door assembly 110 includes a sub-door 160 provided to open and close the second opening 180*a*.

The first laundry item inlet 2*a* may be opened and closed by the door main body 120, the second opening 180*a* may be opened and closed by the sub-door 160, and the first laundry item inlet 2*a* and the second opening 180*a* may be opened and closed independently.

By the configuration above, even when the first laundry item inlet 2*a* is closed by the door main body 120 for a washing operation, the second opening 180*a* may be opened for additionally inserting laundry items or detergent.

The door assembly 110 may include a door rotation unit 190 and a door locking unit 192.

The door rotation unit 190 is provided so that the door main body 120 can rotate with respect to the cabinet 10. The door rotation unit 190 is coupled to one side of the door main body 120, and the door main body 120 rotates with respect to the cabinet 10 for opening and closing operations of the first laundry item inlet 2*a*.

The door locking unit 192 is coupled to the other side of the door main body 120 and is provided to remain closed when the first laundry item inlet 2*a* is closed by the door main body 120. An insertion unit corresponding to the door locking unit 192 is provided in the cabinet 10 and is provided to have the door locking unit 192 inserted therein when the first laundry item inlet 2*a* is closed by the door main body 120.

Figure 11:
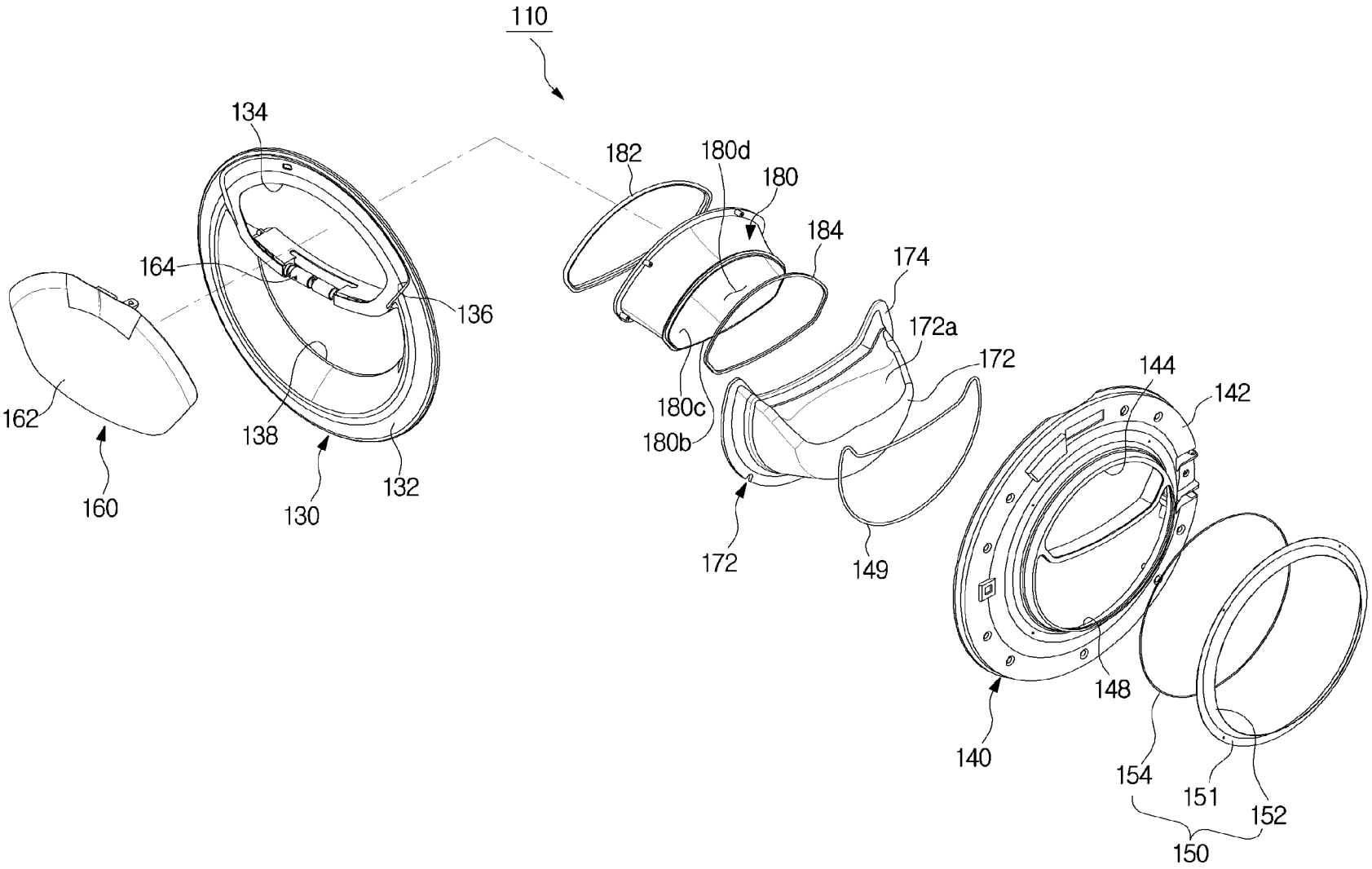
FIG. 11 illustrates a door assembly according to various embodiments of the present disclosure.
Figure 12:
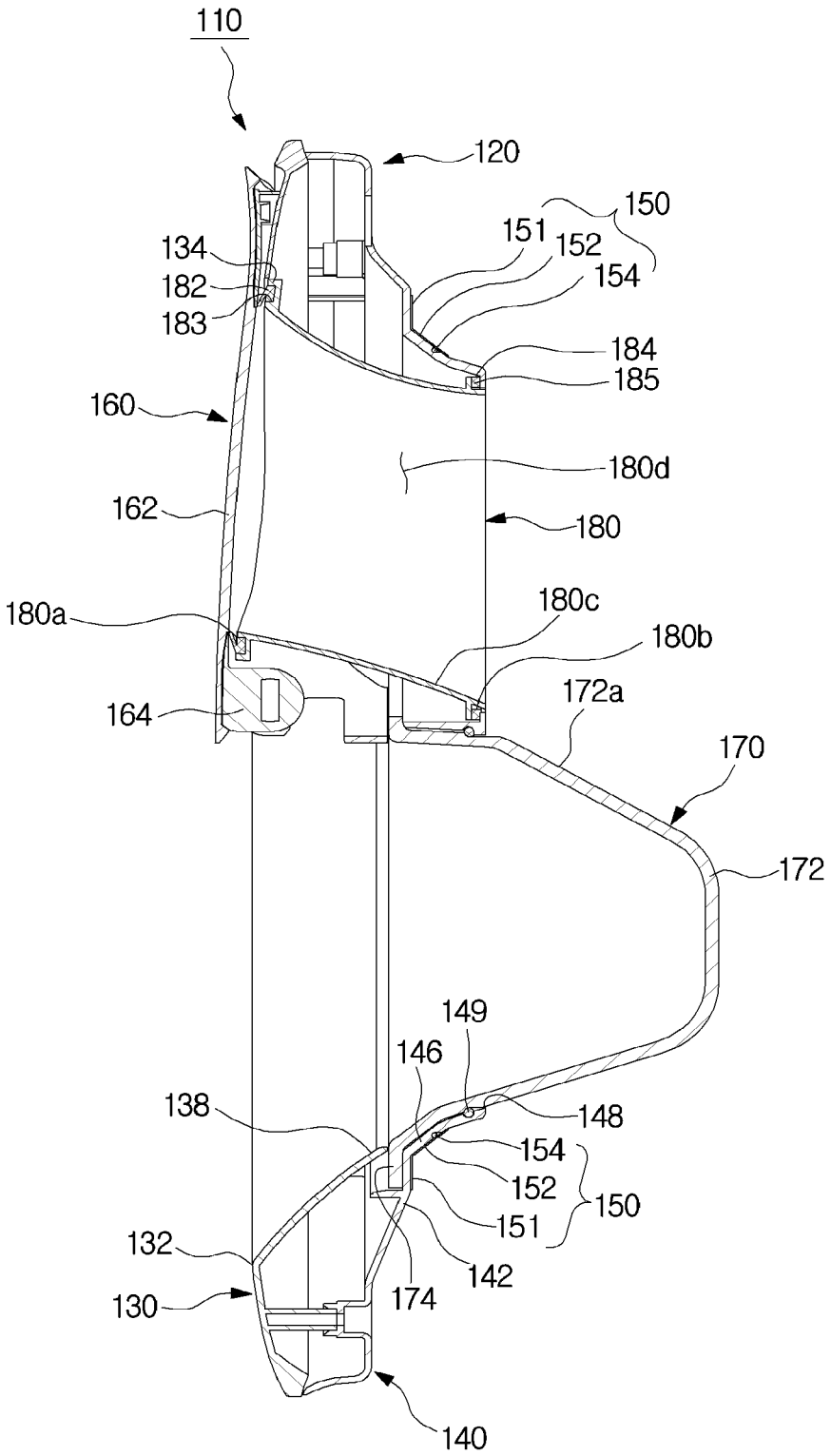
FIG. 12 illustrates the door assembly according to various embodiments of the present disclosure.

FIG. 11 is an exploded perspective view of a door assembly according to another embodiment of the present disclosure, and FIG. 12 is a cross-sectional view of the door assembly according to another embodiment of the present disclosure.

The front cover 130 may include a cover body 132 and a cover opening 134 provided at the cover body 132. The second opening 180*a* is provided to be disposed at the cover opening 134. Specifically, a front end of a connection chute 180 that forms the second opening 180*a* to be described below is provided to be disposed inside of the cover opening 134. The cover body 132 may be provided to form a front surface of the door assembly 110.

The sub-door 160 may be provided to open and close the second opening 180*a*. The sub-door 160 is provided to be rotatable with respect to the front cover 130 and is provided to open and close the second opening 180*a*.

The sub-door 160 includes a sub-door body 162 corresponding to the second opening 180*a* and a sub-door hinge unit 164 provided at one side of the sub-door body 162 to allow the sub-door body 162 to be rotatable.

The sub-door body 162 is formed to have the same or a wider width than that of the second opening 180*a* to allow the second opening 180*a* to be stably closed when the second opening 180*a* is closed by the sub-door 160.

The front cover 130 may include a sub-door seating unit 136. The sub-door seating unit 136 may be more concavely formed than an outer surface of the front cover 130. By the configuration above, at least a portion of the sub-door body 162 is provided to be seated on the sub-door seating unit 136 to allow the closed state of the second opening 180*a* to be stably maintained when the second opening 180*a* is closed by the sub-door 160. In addition, since a step between an outer surface of the sub-door 160 and the outer surface of the front cover 130 may be eliminated or reduced when the second opening 180*a* is closed by the sub-door 160, the product performance can be improved and aesthetics may be improved.

The front cover 130 may include a front window 138 formed to correspond to the door glass 170. The front window 138 may be formed as an opening to allow the inside of the drum 30 to be viewed through the door glass 170 disposed at the rear of the front cover 130. The front window 138 may be provided at a lower portion of the cover opening 134. Although the front window 138 may be provided as an opening, embodiments are not limited thereto. For example, a transmission member (not shown) formed of a transparent material may also be provided at the front window 138 in order to protect the door glass 170.

The door glass 170 is provided to allow the inside of the cabinet 10 to be viewed even when the first laundry item inlet 2*a* is closed by the door assembly 110. The door glass 170 may include a glass body 172 convexly formed to protrude past the rear holder 140. The glass body 172 may be formed of a transparent glass material to allow the inside of the cabinet 10 to be viewed.

The door glass 170 may be disposed at a lower portion than the second opening 180*a* in the door assembly 110. The glass body 172 may include an insertion guide surface 172*a* formed at an upper portion thereof to be tilted downward toward the rear. The second opening 180*a* is disposed at an upper portion than the door glass 170, causing laundry items or detergent inserted through the second opening 180*a* to enter the drum 30 along the insertion guide surface 172*a*. The insertion guide surface 172*a* may be tilted downward toward the rear of the door assembly 110 and may be formed to have a central portion to be more concave downward with respect to left and right. By the configuration above, the insertion guide surface 172*a* may guide laundry items or detergent inserted through the second opening 180*a* to easily enter the drum 30.

The insertion guide surface 172*a* may be formed in a direction extending from a connection guide surface 180*c* to be described below. The insertion guide surface 172*a* may be provided to guide laundry items or detergent guided by the connection guide surface 180*c* into the cabinet 10. Although the insertion guide surface 172*a* is formed to be concave downward in the embodiment, embodiments are not limited thereto. For example, the insertion guide surface 172*a* may also be formed to be convex upward and may also be formed as a flat surface parallel to the height of a rear end of the second opening 180*a*.

The door glass 170 may further include a glass flange 174 provided in the shape of a flange at an end portion of the glass body 172 to be seated on the rear holder 140. The glass flange 174 is seated on a glass seating unit 146 of the rear holder 140 to be described below to prevent the door glass 170 from being detached from the door assembly 110.

The rear holder 140 may be provided at the rear of the front cover 130.

The rear holder 140 may include a holder body 142 and a holder opening 144 provided at the holder body 142 to form at least a portion of the second opening 180*a*. The holder body 142 may be provided to form at least a portion of the rear surface of the door assembly 110.

The door main body 120 of the door assembly 110 may include the connection chute 180. The connection chute 180 is provided to form the second opening 180*a*. A front end of the connection chute 180 may be disposed inside of the cover opening 134 of the front cover 130, and a rear end of the connection chute 180 may be disposed inside of the holder opening 144 of the rear holder 140. That is, the connection chute 180 may be provided between the front cover 130 and the rear holder 140 to form the second opening 180*a* that allows the outer portion and the inside of the cabinet 10 to communicate with each other.

The connection chute 180 may be formed in the shape of a pipe with both sides opened. Specifically, the second opening 180*a* may be formed at one side of the connection chute 180, and a discharge opening 180*b* heading toward the inside of the cabinet 10 may be formed at the other side of the connection chute 180. Laundry items or detergent inserted through the second opening 180*a* moves to the discharge opening 180*b* through a hollow portion 180*d* formed inside the connection chute 180 to be discharged to the inside of the cabinet 10.

The connection chute 180 may include the connection guide surface 180*c*. The connection guide surface 180*c* is formed to form a bottom surface of the connection chute 180. The connection guide surface 180*c* is formed between the second opening 180*a* and the discharge opening 180*b* to be provided to guide laundry items or detergent inserted through the second opening 180*a* to the inside of the cabinet 10 through the discharge opening 180*b*.

The shape of the connection guide surface 180*c* is not limited. For example, the connection guide surface 180*c* may be provided to be tilted downward from the front toward the rear.

In the connection chute 180, the second opening 180*a* may be formed higher than the discharge opening 180*b*. That is, the connection chute 180 may be provided to have a downward slope toward the rear. By the configuration above, when laundry items or detergent is inserted through the second opening 180*a*, the laundry items or detergent may easily be inserted into the inside of the cabinet 10 through the connection chute 180 having the downward slope toward the rear.

A front sealing unit 182 and a rear sealing unit 184 may be provided at the front and the rear of the connection chute 180.

The front sealing unit 182 may be provided at the front end of the connection chute 180 to come in contact with the sub-door 160 to form a sealing structure. A front sealing groove 183 is formed at the front end of the connection chute 180 so that the front sealing unit 182 may be fixed.

The front sealing unit 182 is formed adjacent to the second opening 180*a* so that the front sealing unit 182 and the sub-door 160 come in contact to form a sealing structure when a sub-opening closes the second opening 180*a*. The front sealing unit 182 may be formed adjacently along the circumference of the second opening 180*a*.

By the front sealing unit 182 forming the sealing structure together with the sub-door 160 at the second opening 180*a*, leakage of water from the inside of the cabinet 10 may be prevented when the sub-door 160 is closed.

The rear sealing unit 184 may be provided at the rear end of the connection chute 180 to form a sealing structure between the rear end of the connection chute 180 and the holder opening 144. A rear sealing groove 185 may be formed at the rear end of the connection chute 180 so that the rear sealing unit 184 may be fixed. Since the holder opening 144 is disposed along the circumference of the discharge opening 180*b*, the rear sealing groove 185 may be formed outside of the rear end of the connection chute 180.

The rear sealing unit 184 may be formed adjacent to the discharge opening 180*b* to form a sealing structure between the rear sealing unit 184 and the holder opening 144. The rear sealing unit 184 may be disposed adjacent to the discharge opening 180*b* along the circumference of the discharge opening 180*b*.

By the rear sealing unit forming the sealing structure together with the holder opening 144 at the discharge opening 180*b*, leakage of water from the inside of the cabinet 10 to the inside of the door assembly 110 may be prevented.

Although the connection chute 180 is provided between the front cover 130 and the rear holder 140 in the embodiment, the arrangement and the configuration thereof are not limited thereto. For example, the connection chute 180 may be integrally formed with the front cover 130 or the rear holder 140. In addition, the connection chute 180 may be integrally formed with both of the front cover 130 and the rear holder 140. That is, the connection chute 180 may be integrally formed with at least one of the front cover 130 and the rear holder 140.

The rear holder 140 includes the glass seating unit 146 on which the door glass 170 is seated. A rear window 148 may be formed at the glass seating unit 146 to allow the glass body 172 to pass through the rear glass hole 148. In addition, the glass flange 174 may be configured to be seated at the rear of the glass seating unit 146 to prevent the door glass 170 from being detached from the rear holder 140. A seating sealing unit 149 may be provided between the glass seating unit 146 and the glass flange 174 to prevent leakage of water.

The rear holder 140 may include the door sealing unit 150.

The door sealing unit 150 is provided to come in contact with the diaphragm 90 to seal the inside of the cabinet 10 when the first laundry item inlet 2*a* is closed by the door assembly 110. The door sealing unit 150 may be formed in a ring shape to correspond to the diaphragm 90 in a ring shape. The door sealing unit 150 may be provided to come in contact with the whole region of the circumference of the diaphragm 90 to form a sealing structure to prevent wash water inside the cabinet 10 from leaking through the first laundry item inlet 2*a*. Although the door sealing unit 150 is formed in a ring shape in the embodiment, the door sealing unit 150 may also have a polygonal shape corresponding to the shape of the diaphragm 90 and may also have an oval shape.

The second opening 180*a* may be provided to be spaced apart toward inside of the door sealing unit 150. When the first laundry item inlet 2*a* is closed by the door assembly 110, the second opening 180*a* may be provided to be spaced apart from the door sealing unit 150 inside of the door sealing unit 150 not to interfere with the diaphragm 90. Further, the holder opening 144 formed along the circumference of the second opening 180*a* may also be provided to be spaced apart toward the inside of the door sealing unit 150.

The door glass 170 may be provided to be spaced apart toward the inside of the door sealing unit 150. When the first laundry item inlet 2*a* is closed by the door assembly 110, the door glass 170 may be provided to be spaced apart from the door sealing unit 150 inside of the door sealing unit 150 not to interfere with the diaphragm 90. In the embodiment, the second opening 180*a* and the door glass 170 may be disposed to be spaced apart from the door sealing unit 150 inside of the door sealing unit 150. In detail, the rear end of the second opening 180*a* and the door glass 170 may be disposed to be spaced apart from the door sealing unit 150 inside of the door sealing unit 150.

The door sealing unit 150 may be provided in a material that comes in contact with the diaphragm 90 to form a sealing structure. For example, the door sealing unit 150 may be provided to include at least one of a glass material and an elastic member. In addition, the door sealing unit 150 may also be formed of a material with a smooth surface. In addition, the door sealing unit 150 may be provided to be injection-molded together with the rear holder 140. The material of the door sealing unit 150 is not limited and may be any material that can form a sealing structure together with the diaphragm 90 by coming in contact with the diaphragm 90.

The second opening 180*a* may be provided to be smaller than the first laundry item inlet 2*a*. The first laundry item inlet 2*a* may be provided at the cabinet 10 and be opened and closed by the door assembly 110, and the second opening 180*a* may be provided at the door assembly 110 and be opened and closed by the sub-door 160. By the configuration above, even when the first laundry item inlet 2*a* is closed, the second opening 180*a* may be opened for additionally inserting laundry items or detergent into the cabinet 10.

Figure 13:
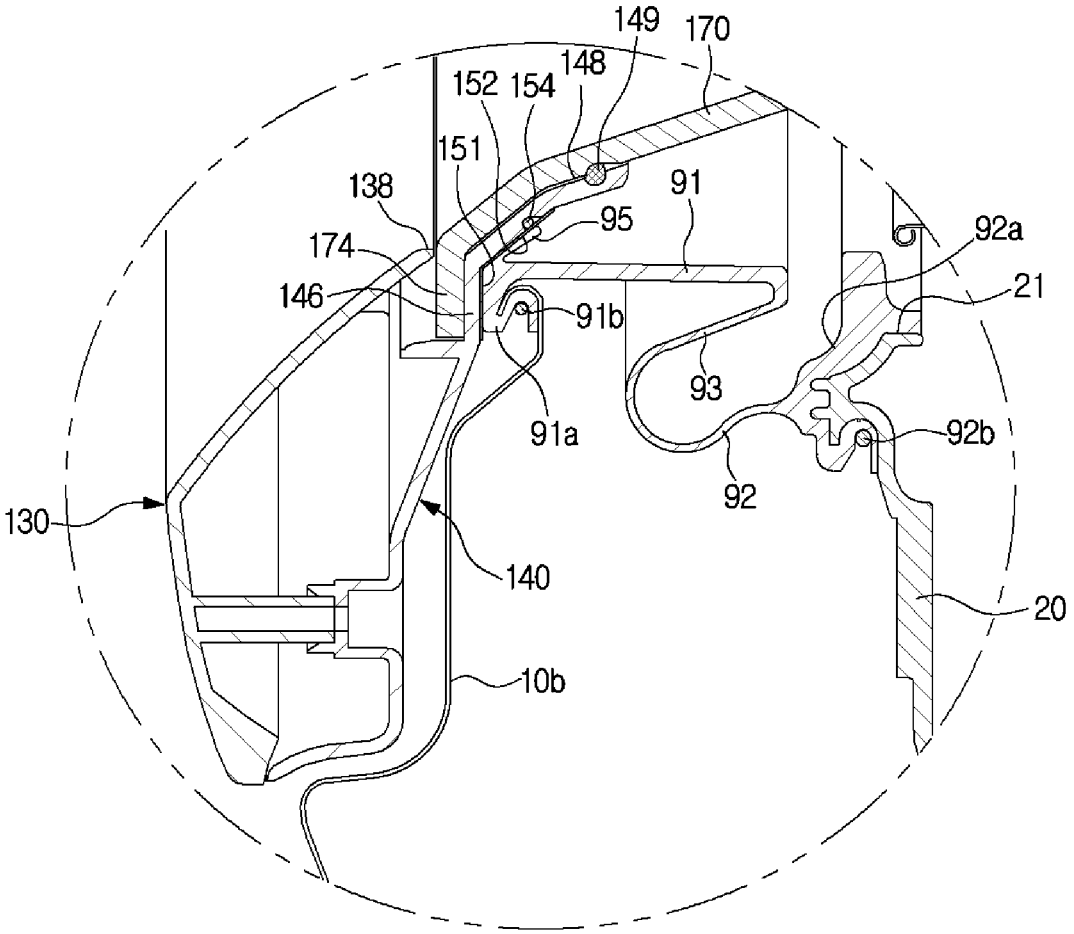
FIG. 13 illustrates a part of the door assembly according to various embodiments of the present disclosure.

FIG. 13 is an enlarged cross-sectional view of a part of the door assembly according to another embodiment of the present disclosure.

The diaphragm 90 includes bodies 91 and 92 disposed between an opening of the front frame 10*b* and the opening 21 of the tub 20 when installed in the washing machine 100. The bodies 91 and 92 include hollow portions which become passages through which laundry items are inserted and withdrawn. When the door is closed, the door glass is accommodated in the hollow portions of the diaphragm 90.

The bodies 91 and 92 may include a first body part 91 and a second body part 92 formed in a cylindrical shape. A front end of the first body part 91 is coupled to the opening of the front frame 10*b*, and a rear end of the first body part 91 is disposed to be adjacent to the opening of the tub 20.

The second body part 92 has a larger diameter than the first body part 91. A rear end of the second body part 92 is coupled to the opening of the tub 20, and a front end of the second body part 92 is disposed further forward than the rear end of the first body part 91.

The rear end of the first body part 91 and the front end of the second body part 92 are connected to each other by a body connection part 93. The body connection part 93 effectively attenuates vibration transmitted from the tub 20 to the cabinet 10 by having a structure bent several times.

A cabinet coupling part 91*a* coupled to the front frame 10*b* of the cabinet 10 is provided at the front end of the first body part 91. An edge of the front frame 10*b* that forms the opening is coupled to the cabinet coupling part 91*a*. A wire 91*b* is coupled to the cabinet coupling part 91*a* to prevent the diaphragm 90 from being detached from the cabinet 10.

In addition, a lip 95 is formed at the front end of the first body part 91. The lip 95 protrudes from the front end of the first body part 91 toward the hollow portions and is formed in a ring shape along the circumferential direction of the front end of the first body part 91. A front surface of the lip 95 faces the door assembly 110, and a rear surface behind the front surface of the lip 95 faces the drum 30. When the door assembly 110 of the washing machine 100 is closed, the front surface of the lip 95 comes in contact with the door sealing unit 150 for sealing to prevent water from leaking through a portion between the door assembly 110 and the front frame 10*b* of the cabinet 10.

A tub coupling part 92*a* is provided at the rear end of the second body part 92. An edge of the tub 20 that forms the opening is coupled to the tub coupling part 92*a*. A wire 92*b* is coupled to the tub coupling part 92*a* to prevent the diaphragm 90 from being detached from the tub 20.

The door sealing unit 150 is provided to face the diaphragm 90 to come in contact with the diaphragm 90 to form a sealing structure when the first laundry item inlet 2*a* is closed by the door assembly 110.

The door sealing unit 150 may include a first sealing unit 151 and a second sealing unit 152.

The first sealing unit 151 is provided to face the diaphragm 90. For example, since the diaphragm 90 may be formed in a ring shape, the first sealing unit 151 may also be formed in the ring shape.

The second sealing unit 152 is provided to be bent toward the rear of the door assembly 110 inside of the first sealing unit 151. The second sealing unit 152 may be provided to extend from the first sealing unit 151, and the first sealing unit 151 and the second sealing unit 152 may be integrally formed.

When the first laundry item inlet 2*a* is closed by the door assembly 110, the lip 95 of the diaphragm 90 formed of an elastic material comes in contact with the door sealing unit 150. In this process, the lip 95 of the diaphragm 90 is pressed by the door assembly 110 and may be adhered to the door sealing unit 150 by being elastically deformed due to elasticity. In detail, the lip 95 of the diaphragm 90 is provided to come in contact with at least one of the first sealing unit 151 and the second sealing unit 152 provided to be bent from the first sealing unit 151 to form a sealing structure. For example, the lip 95 of the diaphragm 90 may be elastically deformed due to elasticity to come in contact with both the first sealing unit 151 and the second sealing unit 152.

The door sealing unit 150 may include a sealing wire 154. The sealing wire 154 is provided between the sealing units 151 and 152 and the rear holder 140 to prevent wash water from being introduced through a portion between the sealing units 151 and 152 and the rear holder 140. The sealing wire 154 may be provided along insides of the sealing units 151 and 152. Although an arrangement of the sealing wire 154 is not limited, the sealing wire 154 may be arranged between the inside of the second sealing unit 152 and the rear holder 140.

Hereinafter, a washing machine according to still another embodiment of the present disclosure will be described.

Figure 14:
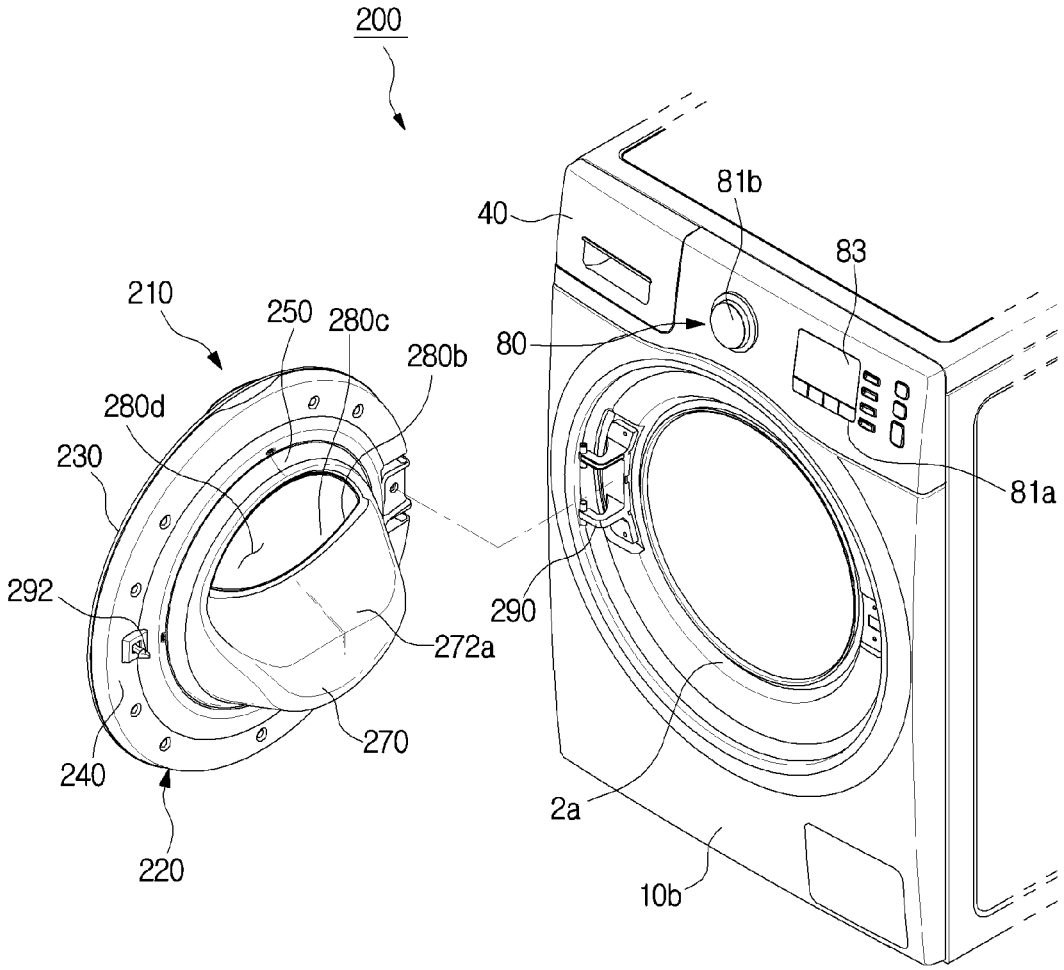
FIG. 14 illustrates a cabinet and a door assembly of a washing machine are detached from each other according to various embodiments of the present disclosure.

FIG. 14 is a view in which a cabinet and a door assembly of a washing machine according to still another embodiment of the present disclosure are detached from each other.

A washing machine 200 may include the cabinet 10, the tub 20 that accommodates wash water or rinse water to be used in a washing operation or a rinsing operation and the drum 30 that accommodates laundry items.

The first laundry item inlet 2*a* is formed at the front frame 10*b* of the cabinet 10 to allow laundry items to be inserted into the drum 30. The first laundry item inlet 2*a* may be opened and closed by the door assembly 210 installed at the front frame 10*b* of the cabinet 10. The first laundry item inlet 2*a* is the same configuration as the laundry item inlet 2*a* in FIG. 2.

The door assembly 210 may include a door main body 220 rotatably provided at the cabinet 10.

The door main body 220 may include a front cover 230 and a rear holder 240.

The front cover 230 forms a front surface of the door main body 220, and the rear holder 240 forms at least a portion of a rear surface of the door main body 220 from behind the front cover 230.

The door assembly 210 may include a door glass 270. The door glass 270 is provided to correspond to the first laundry item inlet 2*a*, and the door glass 270 is provided to come in contact with the first laundry item inlet 2*a* when the door assembly 210 is at a closed position.

The door glass 270 may be formed of a transparent material to allow the inside of the drum 30 to be viewed from the outside of the washing machine 200 even when the door assembly 210 is at the closed position. The door glass 270 may be disposed to convexly protrude from the rear holder 240. By the configuration above, when the door assembly 210 is at the closed position, the door glass 270 is provided to be inserted further inward to the inside of the cabinet 10 than the first laundry item inlet 2*a*.

A second opening 280*a* provided to be opened and closed independently of the first laundry item inlet 2*a* is provided at the door main body 220. The door assembly 210 includes a sub-door 260 provided to open and close the second opening 280*a*.

The first laundry item inlet 2*a* may be opened and closed by the door main body 220, the second opening 280*a* may be opened and closed by the sub-door 260, and the first opening laundry item inlet 2*a* and the second opening 280*a* may be opened and closed independently of each other.

By the configuration above, even when the first laundry item inlet 2*a* is closed by the door main body 220 for the washing operation, the second opening 280*a* may be opened for additionally inserting laundry items or detergent.

The door assembly 210 may include a door rotation unit 290 and a door locking unit 292.

The door rotation unit 290 is provided so that the door main body 220 can rotate with respect to the cabinet 10. The door rotation unit 290 is coupled to one side of the door main body 220, and the door main body 220 rotates with respect to the cabinet 10 for opening and closing operations of the first laundry item inlet 2*a*.

The door locking unit 292 is coupled to the other side of the door main body 220 and is provided to remain closed when the first laundry item inlet 2*a* is closed by the door main body 220. An insertion unit (not shown) corresponding to the door locking unit 292 is provided in the cabinet 10 and is provided to have the door locking unit 292 inserted therein when the first laundry item inlet 2*a* is closed by the door main body 220.

Figure 15:
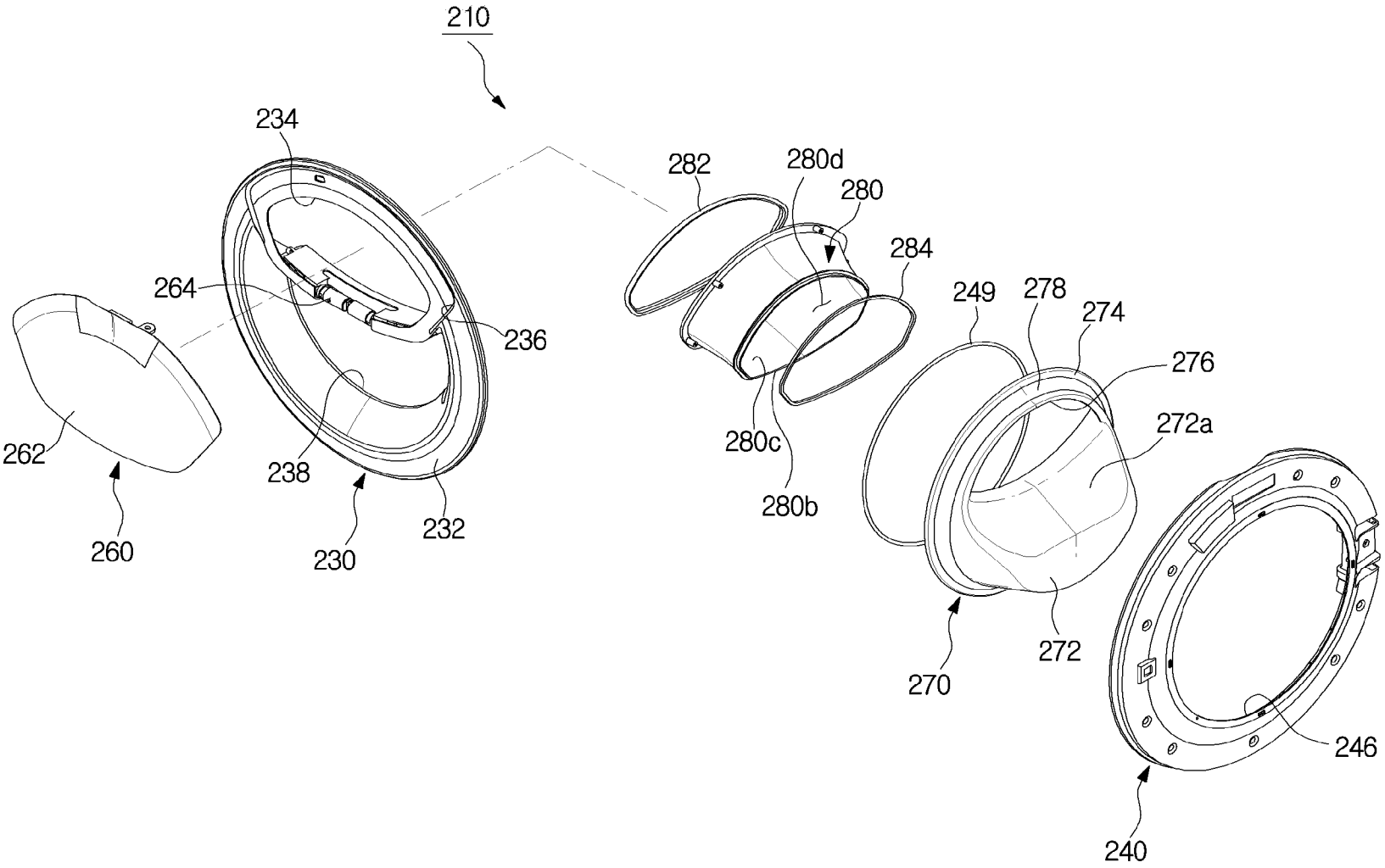
FIG. 15 illustrates the door assembly according to various embodiments of the present disclosure.
Figure 16:
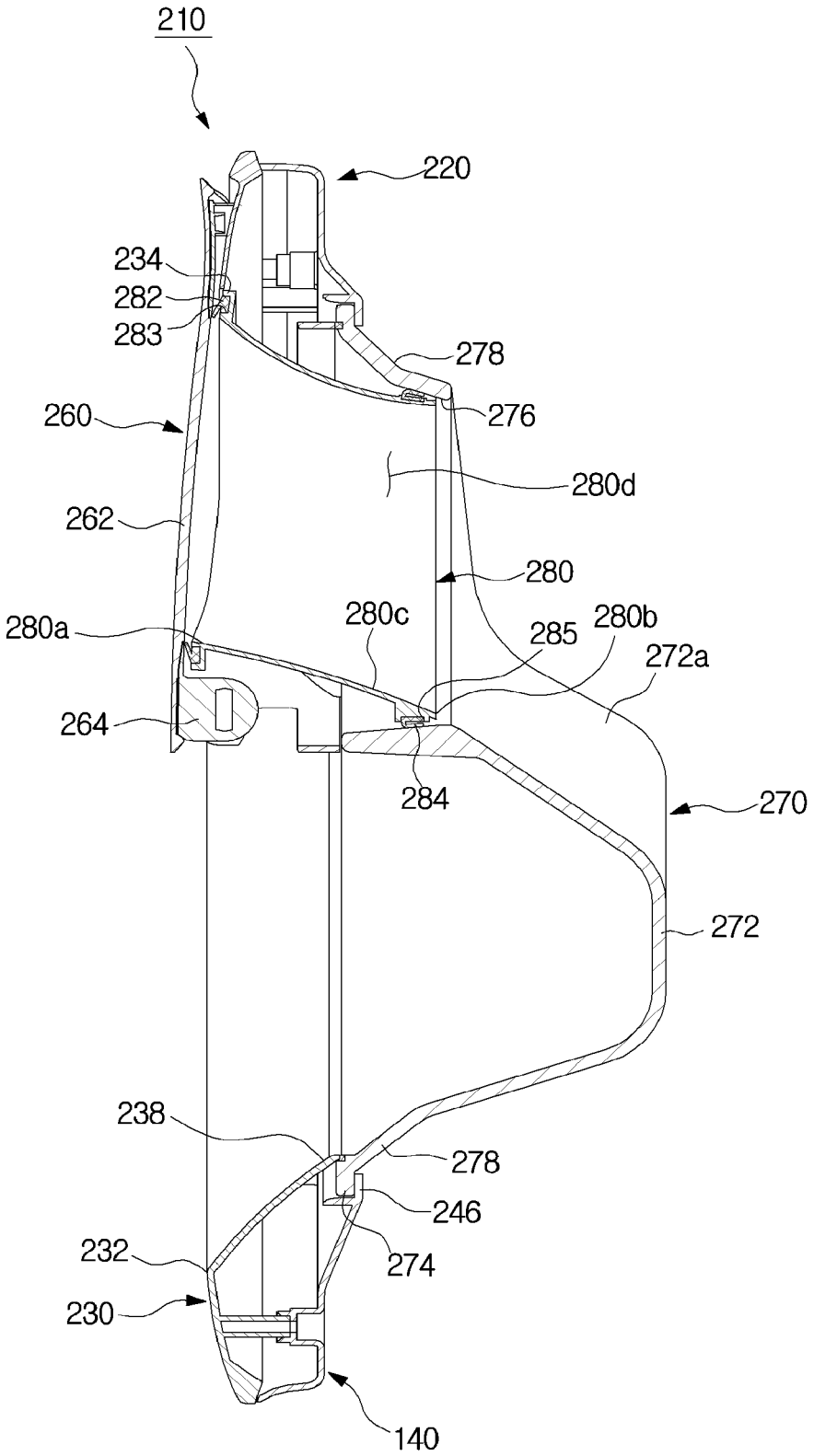
FIG. 16 illustrates the door assembly according to various embodiments of the present disclosure.

FIG. 15 is an exploded perspective view of a door assembly according to still another embodiment of the present disclosure, and FIG. 16 is a cross-sectional view of the door assembly according to still another embodiment of the present disclosure.

The front cover 230 may include a cover body 232 and a cover opening 234 provided at the cover body 232. A front end of the second opening 280*a* is provided to be disposed at the cover opening 234. Specifically, a front end of a connection chute 280 that forms the second opening 280*a* to be described below is provided to be disposed inside of the cover opening 234. The cover body 232 may be provided to form a front surface of the door assembly 210.

The sub-door 260 may be provided to open and close the second opening 280*a*. The sub-door 260 is provided to be rotatable with respect to the front cover 230 and is provided to open and close the second opening 280*a*.

The sub-door 260 includes a sub-door body 262 corresponding to the second opening 280*a* and a sub-door hinge unit 264 provided at one side of the sub-door body 262 to allow the sub-door body 262 to be rotatable.

The sub-door body 262 is formed to have the same or a wider width than that of the second opening 280*a* to allow the second opening 280*a* to be stably closed when the second opening 280*a* is closed by the sub-door 260.

The front cover 230 may include a sub-door seating unit 236. The sub-door seating unit 236 may be more concavely formed than an outer surface of the front cover 230. By the configuration above, at least a portion of the sub-door body 262 is provided to be seated on the sub-door seating unit 236 to allow the closed state of the second opening 280*a* to be stably maintained when the second opening 280*a* is closed by the sub-door 260. In addition, since a step between an outer surface of the sub-door 260 and the outer surface of the front cover 230 may be eliminated or reduced when the second opening 280*a* is closed by the sub-door 260, the product performance can be improved and aesthetics may be improved.

The front cover 230 may include a front window 238 formed to correspond to the door glass 270. The front window 238 may be formed as an opening to allow the inside of the drum 30 to be viewed through the door glass 270 disposed at the rear of the front cover 230. The front window 238 may be provided at a lower portion of the cover opening 234. Although the front window 238 may be provided as an opening, embodiments are not limited thereto. For example, a transmission member (not shown) formed of a transparent material may also be provided at the front window 238 in order to protect the door glass 270.

The door glass 270 is provided to allow the inside of the cabinet 10 to be viewed even when the first laundry item inlet 2*a* is closed by the door assembly 210. The door glass 270 may include a glass body 272 convexly formed to protrude past the rear holder 240. The glass body 272 may be formed of a transparent glass material to allow the inside of the cabinet 10 to be viewed.

The glass body 272 may be disposed at a lower portion than the second opening 280*a* in the door assembly 210. The glass body 272 may include an insertion guide surface 272*a* formed at an upper portion thereof to be tilted downward toward the rear. The second opening 280*a* is disposed at an upper portion than the glass body 272, causing laundry items or detergent inserted through the second opening 280*a* to enter the drum along the insertion guide surface 272*a*. The insertion guide surface 272*a* may be tilted downward toward the rear of the door assembly 210 and may be formed to have a central portion to be more concave downward with respect to left and right. By the configuration above, the insertion guide surface 272*a* may guide laundry items or detergent inserted through the second opening 280*a* to easily enter the drum 30.

The insertion guide surface 272*a* may be formed in a direction extending from a connection guide surface 280*c* to be described below. The insertion guide surface 272*a* may be provided to guide laundry items or detergent guided by the connection guide surface 280*c* into the cabinet 10. Although the insertion guide surface 272*a* is formed to be concave downward in the illustrated embodiment, the various embodiments are not limited thereto. For example, the insertion guide surface 272*a* may also be formed to be convex upward and may also be formed as a flat surface parallel to the height of a rear end of the second opening 280*a*.

The door glass 270 may include a glass opening 276 and a door sealing unit 278. The glass opening 276 is configured to be opened corresponding to the second opening 280*a* at the door glass 270. The glass opening 276 may be formed on the door glass 270 in a shape in which at least a portion is opened corresponding to the second opening 280*a* at the door glass 270.

The door sealing unit 278 is provided to come in contact with the diaphragm 90 to seal the inside of the cabinet 10 when the first laundry item inlet 2*a* is closed by the door assembly 210. The door sealing unit 278 may be formed in a ring shape to correspond to the diaphragm 90 in the ring shape. The door sealing unit 278 may be provided to come in contact with the whole region of the circumference of the diaphragm 90 to form a sealing structure in order to prevent wash water inside the cabinet 10 from leaking through the first laundry item inlet 2*a*. Although the door sealing unit 278 is formed in the ring shape in the embodiment, the door sealing unit 278 may also have a polygonal shape corresponding to the shape of the diaphragm 90 or have an oval shape.

The second opening 280*a* may be provided to be spaced apart toward an inside of the door sealing unit 278. When the first laundry item inlet 2*a* is closed by the door assembly 210, the glass opening 276 may be provided to be spaced apart from the door sealing unit 278 inside of the door sealing unit 278 not to interfere with the diaphragm 90. Further, the glass opening 276 formed along the circumference of the second opening 280*a* may also be provided to be spaced apart toward the inside of the door sealing unit 278.

The door sealing unit 278 may be provided in a material that comes in contact with the diaphragm 90 to form a sealing structure. For example, the door sealing unit 278 may include a glass material. In addition, the door sealing unit 278 and the glass body 272 may be integrally formed with the glass material. In addition, the door sealing unit 278 may also be formed of a material with a smooth surface. The material of the door sealing unit 278 is not limited and may be any material that can form a sealing structure together with the diaphragm 90 by coming in contact with the diaphragm 90.

The second opening 280*a* may be provided to be smaller than the first laundry item inlet 2*a*. The first laundry item inlet 2*a* may be provided at the cabinet 10 and be opened and closed by the door assembly 210, and the second opening 280*a* may be provided at the door assembly 210 and be opened and closed by the sub-door 260. By the configuration above, even when the first laundry item inlet 2*a* is closed, the second opening 280*a* may be opened for additionally inserting laundry items or detergent into the cabinet 10.

The door glass 270 may further include a glass flange 274 provided in the shape of a flange at an end portion of the door sealing unit 278 to be seated on the rear holder 240. The glass flange 274 is seated on a glass seating unit 246 of the rear holder 240 to be described below to prevent the door glass 270 from being detached from the door assembly 210.

The door main body 220 of the door assembly 210 may include the connection chute 280. The connection chute 280 is provided to form the second opening 280*a*. A front end of the connection chute 280 may be disposed inside of the cover opening 234 of the front cover 230, and a rear end of the connection chute 280 may be disposed inside of a holder opening 244 of the rear holder 240. That is, the connection chute 280 may be provided between the front cover 230 and the rear holder 240 to form the second opening 280*a* that allows the outer portion and the inside of the cabinet 20 10 to communicate with each other.

The connection chute 280 may be formed in the shape of a pipe with both sides opened. Specifically, the second opening 280*a* may be formed at one side of the connection chute 280, and a discharge opening 280*b* heading toward the inside of the cabinet 20 10 may be formed at the other side of the connection chute 280. Laundry items or detergent inserted through the second opening 280*a* moves to the discharge opening 280*b* through a hollow portion 280*d* formed inside the connection chute 280 to be discharged inside of the cabinet 2010. The shape of the connection chute 280 is not limited to the shape of the pipe. For example, the connection chute 280 may also be formed in the shape of a surface that may guide laundry items or detergent inserted through the second opening 280*a* to the discharge opening 280*b*. In addition, the connection chute 280 may also be provided in the shape of a flat surface or a curved surface that connects a lower portion of the second opening 280*a* to a lower portion of the discharge opening 280*b*.

The connection chute 280 may include the connection guide surface 280*c*. The connection guide surface 280*c* is formed to form a bottom surface of the connection chute 280. The connection guide surface 280*c* is formed between the second opening 280*a* and the discharge opening 280*b* to be provided to guide laundry items or detergent inserted through the second opening 280*a* to the inside of the cabinet 20 10 through the discharge opening 280*b*.

The shape of the connection guide surface 280*c* is not limited. For example, the connection guide surface 280*c* may be provided to be tilted downward from the front toward the rear.

In the connection chute 280, the second opening 280*a* may be formed above the discharge opening 280*b*. That is, the connection chute 280 may be provided to have a downward slope toward the rear. By the configuration above, when laundry items or detergent is inserted through the second opening 280*a*, the laundry items or detergent may easily be inserted to the inside of the cabinet 10 through the connection chute 280 having the downward slope toward the rear.

A front sealing unit 282 and a rear sealing unit 284 may be provided at the front and the rear of the connection chute 280.

The front sealing unit 282 may be provided at the front end of the connection chute 280 to come in contact with the sub-door 260 to form a sealing structure. A front sealing groove 283 is formed at the front end of the connection chute 280 so that the front sealing unit 282 may be fixed.

The front sealing unit 282 is formed adjacent to the second opening 280*a* so that the front sealing unit 282 and the sub-door 260 come in contact to form a sealing structure when a sub-opening closes the second opening 280*a*. The front sealing unit 282 may be formed adjacently along the circumference of the second opening 280*a*.

By the front sealing unit 282 forming the sealing structure together with the sub-door 260 at the second opening 280*a*, leakage of water from the inside of the cabinet 10 may be prevented when the sub-door 260 is closed.

The rear sealing unit 284 may be provided at the rear end of the connection chute 280 to form a sealing structure between the rear end of the connection chute 280 and the glass opening 276. A rear sealing groove 285 may be formed at the rear end of the connection chute 280 so that the rear sealing unit 284 may be fixed. Since the glass opening 276 is disposed along the circumference of the discharge opening 280*b*, the rear sealing groove 285 may be formed outside of the rear end of the connection chute 280.

The rear sealing unit 284 may be formed adjacent to the discharge opening 180*b* 280*b* to form a sealing structure between the rear sealing unit 284 and the glass opening 276. The rear sealing unit 284 may be disposed adjacent to the discharge opening 180*b* 280*b* along the circumference of the discharge opening 280*b*.

By the rear sealing unit forming the sealing structure together with the glass opening 276 at the discharge opening 280*b*, leakage of water from the inside of the cabinet 10 to the inside of the door assembly 210 may be prevented.

Although the connection chute 280 is provided between the front cover 230 and the rear holder 240 in the embodiment, the arrangement and the configuration thereof are not limited thereto. For example, the connection chute 280 may be integrally formed with the front cover 230 or the door glass 270. In addition, the connection chute 280 may be integrally formed with both of the front cover 230 and the door glass 270. That is, the connection chute 280 may be integrally formed with at least one of the front cover 230 and the door glass 270.

The rear holder 240 may be provided at the rear of the front cover 230. The rear holder 240 includes the glass seating unit 246 on which the door glass 270 is seated. A rear window may be formed at the glass seating unit 246 to allow the glass body 272 to pass through the rear glass hole. In addition, the glass flange 274 may be seated on the rear of the glass seating unit 246 to be configured to prevent the door glass 270 from being detached from the rear holder 240. A seating sealing unit 249 may be provided between the glass seating unit 246 and the glass flange 274 to prevent leakage of water.

Figure 17:
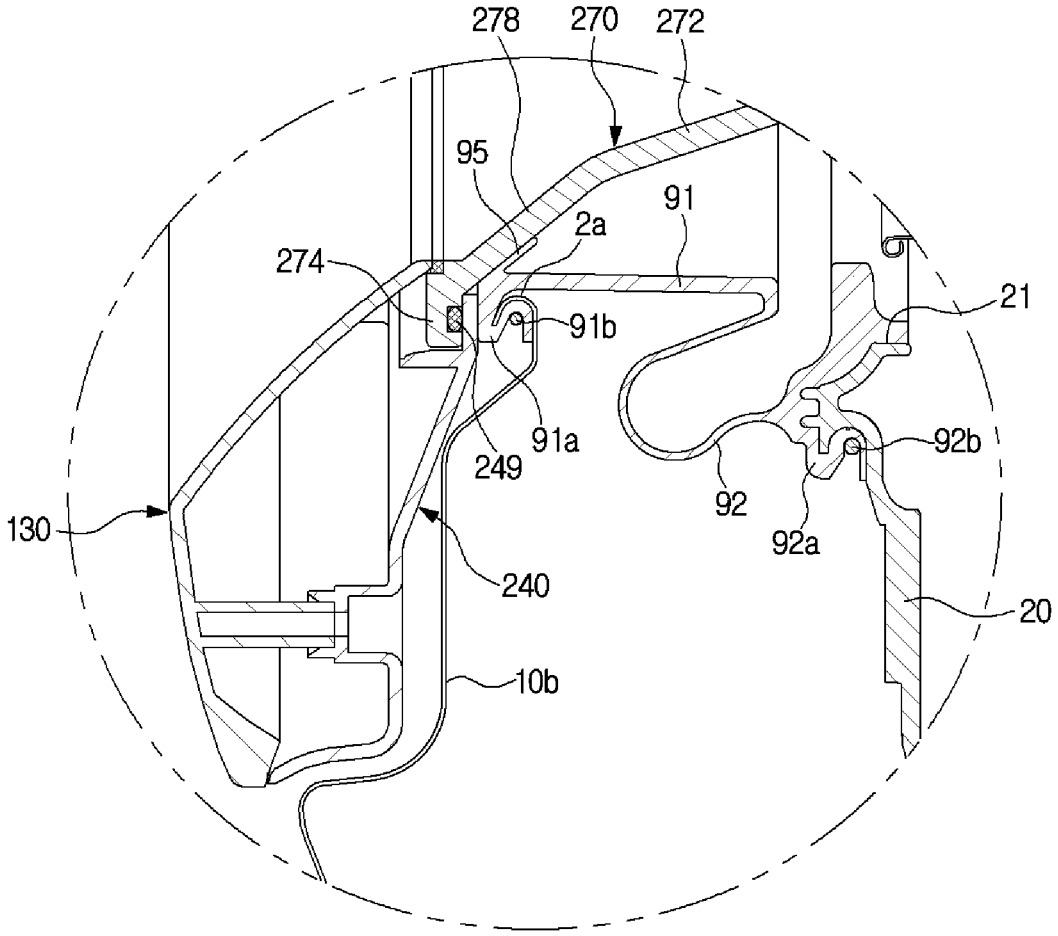
FIG. 17 illustrates a part of the door assembly according to various embodiments of the present disclosure.

FIG. 17 is an enlarged cross-sectional view of a part of the door assembly according to still another embodiment of the present disclosure.

The door sealing unit 278 is provided to face the diaphragm 90 to come in contact with the diaphragm 90 to form a sealing structure when the first laundry item inlet 2*a* is closed by the door assembly 210.

When the first laundry item inlet 2*a* is closed by the door assembly 210, the lip of the diaphragm 90 formed of an elastic material comes in contact with the door sealing unit 278. In this process, the lip of the diaphragm 90 is pressed by the door assembly 210 and is elastically deformed due to elasticity to be adhered to the door sealing unit 278.

Although the present disclosure has been described with an exemplary embodiment, various changes and modifications may be suggested to one skilled in the art. It is intended that the present disclosure encompass such changes and modifications as fall within the scope of the appended claims.

What is claimed is:

1. A washing machine comprising:
a cabinet comprising a first laundry item inlet;
a tub disposed inside the cabinet to retain wash water;
a drum disposed inside the tub to accommodate laundry items; and
a door assembly configured to open and close the first laundry item inlet, wherein the door assembly comprises:
a door glass structured with at least a portion protruding toward an inside of the cabinet when the first laundry item inlet is closed by the door assembly; and
a glass opening provided at the door glass so that, when the first laundry item inlet is closed by the door assembly, the laundry items are accommodated inside the drum through the glass opening, wherein a top surface of the door glass comprises an insertion guide surface configured to form a movement passage of the laundry items from the glass opening into the drum.

2. The washing machine of claim 1, wherein the door assembly further comprises a second laundry item inlet formed at a front side of the door assembly and a connection chute configured to form a second movement passage of the laundry items from the second laundry item inlet to the glass opening.

3. The washing machine of claim 2, wherein the second laundry item inlet is disposed higher than the glass opening.

4. The washing machine of claim 2, wherein the door assembly further comprises a sub-door configured to open and close the second laundry item inlet.

5. The washing machine of claim 1, further comprising:
a tub opening provided at the tub; and
a diaphragm disposed between the first laundry item inlet and the tub opening,
wherein a ring-shaped door sealing unit configured to come in contact with the diaphragm is provided at the door glass.

6. The washing machine of claim 2, wherein the door assembly further comprises:
a front cover at which the second laundry item inlet is provided; and
a rear cover coupled to the front cover,
wherein a ring-shaped flange disposed between the front cover and the rear cover is provided at the door glass.

7. The washing machine of claim 6, wherein a window is provided at the front cover to allow the inside of the cabinet to be viewed.

8. A washing machine comprising:
a cabinet comprising a first laundry item inlet;
a tub disposed inside the cabinet to retain wash water;
a drum disposed inside the tub to accommodate laundry items; and
a main-door configured to correspond to the first laundry item inlet and including a door glass having a glass opening provided so that the laundry items are accommodated inside the drum through the glass opening when the first laundry item inlet is closed by the main-door, wherein a top surface of the door glass comprises an insertion guide surface configured to form a movement passage of the laundry items from the glass opening into the drum.

9. The washing machine of claim 8, further comprising:
a second laundry item inlet formed at the main-door; and
a connection chute configured to extend from the second laundry item inlet to allow the laundry items inserted through the second laundry item inlet to be accommodated in the drum when the first laundry item inlet is closed by the main-door,
wherein an outlet end of the connection chute is disposed lower than the second laundry item inlet.

10. The washing machine of claim 9, wherein the connection chute is tilted downward toward the inside of the cabinet.

11. The washing machine of claim 9, further comprising a sub-door configured to open and close the second laundry item inlet.

12. The washing machine of claim 8, wherein the door glass includes at least a portion protruding toward the inside of the cabinet when the first laundry item inlet is closed by the main-door.

13. The washing machine of claim 8, further comprising:

a tub opening provided at the tub; and a diaphragm disposed between the first laundry item inlet and the tub opening, wherein a ring-shaped door sealing unit configured to come in contact with the diaphragm is provided at the door glass.

14. The washing machine of claim 9, wherein the main-door comprises:

a front cover at which the second laundry item inlet is provided; and a rear cover coupled to the front cover, wherein a ring-shaped flange disposed between the front cover and the rear cover is provided at the door glass.

15. The washing machine of claim 14, wherein a window is provided at the front cover so that at least a portion of the door glass is exposed through the window.

* * * * *